US007355573B2

(12) United States Patent
Ogawa

(10) Patent No.: US 7,355,573 B2
(45) Date of Patent: Apr. 8, 2008

(54) RESIDUAL IMAGE DISPLAY

(75) Inventor: Harumi Ogawa, Suwa (JP)

(73) Assignee: Nittoh Kogaku K.K. (JP)

( * ) Notice: Subject to any disclaimer, the term of this patent is extended or adjusted under 35 U.S.C. 154(b) by 422 days.

(21) Appl. No.: 10/521,696

(22) PCT Filed: Apr. 28, 2004

(86) PCT No.: PCT/JP2004/006172

§ 371 (c)(1),
(2), (4) Date: Jan. 19, 2005

(87) PCT Pub. No.: WO2004/097775

PCT Pub. Date: Nov. 11, 2004

(65) Prior Publication Data

US 2006/0152437 A1 Jul. 13, 2006

(30) Foreign Application Priority Data

Apr. 30, 2003 (JP) ..... 2003-125165

(51) Int. Cl.
*G09G 3/32* (2006.01)

(52) U.S. Cl. ..... 345/82; 345/48; 362/559

(58) Field of Classification Search ..... 345/33–36, 345/38–40, 42, 46, 48, 50, 51–52, 72, 77, 345/82–84, 90, 204, 207, 690, 214; 362/11, 362/29, 601, 611, 612–613, 555, 559
See application file for complete search history.

(56) References Cited

U.S. PATENT DOCUMENTS 5,406,300 A * 4/1995 Tokimoto et al. ..... 345/31
5,670,971 A * 9/1997 Tokimoto et al. ..... 345/31
6,265,984 B1 * 7/2001 Molinaroli ..... 340/815.4
6,449,437 B1 9/2002 Nittou

FOREIGN PATENT DOCUMENTS

| | | | |
|---|---|---|---|
| JP | 04-130983 U | | 12/1992 |
| JP | 04-366883 | * | 12/1992 |
| JP | 05-314720 | | 12/1993 |
| JP | 06-051716 | * | 2/1994 |
| JP | 06-067616 | * | 3/1994 |
| JP | 3007664 U | | 11/1994 |
| JP | 07-013500 | * | 1/1995 |
| JP | 07-134556 | | 5/1995 |
| JP | 08-095516 | * | 4/1996 |
| JP | 08-097969 | * | 4/1996 |
| JP | 10-222099 | | 8/1998 |
| JP | 11-137764 | | 5/1999 |
| JP | 2000-194338 | | 7/2000 |
| JP | 2001-197253 | | 7/2001 |

* cited by examiner

*Primary Examiner*—Richard Hjerpe
*Assistant Examiner*—Mansour M. Said
(74) *Attorney, Agent, or Firm*—Stephen Chin; von Simson & Chin

(57) ABSTRACT

In one of the present invention, a scanning control means and a generating means scan an image by part of light-emitting diodes among a plurality of light-emitting diodes, and generate two-dimensional residual image data enlarged from the image. A light-emission control means controls light emission of the plurality of light-emitting diodes by this enlarged two-dimensional residual image data.

9 Claims, 21 Drawing Sheets

64

| | 1 | 2 | 3 | 4 | 5 | 6 | 7 | 8 | 9 |
|---|---|---|---|---|---|---|---|---|---|
| 1 | 0 | 0 | 0 | 0 | 0 | 0 | 0 | 0 | 0 |
| 2 | 0 | 0 | 0 | 1 | 1 | 1 | 0 | 0 | 0 |
| 3 | 0 | 0 | 1 | 0 | 0 | 0 | 1 | 0 | 0 |
| 4 | 0 | 1 | 0 | 0 | 0 | 0 | 0 | 1 | 0 |
| 5 | 0 | 1 | 0 | 0 | 0 | 0 | 0 | 1 | 0 |
| 6 | 0 | 0 | 0 | 0 | 0 | 0 | 0 | 1 | 0 |
| 7 | 0 | 0 | 0 | 0 | 0 | 0 | 1 | 0 | 0 |
| 8 | 0 | 0 | 0 | 0 | 0 | 1 | 0 | 0 | 0 |
| 9 | 0 | 0 | 0 | 0 | 1 | 0 | 0 | 0 | 0 |
| 10 | 0 | 0 | 0 | 1 | 0 | 0 | 0 | 0 | 0 |
| 11 | 0 | 0 | 1 | 0 | 0 | 0 | 0 | 0 | 0 |
| 12 | 0 | 1 | 1 | 1 | 1 | 1 | 1 | 1 | 0 |

| | 1 | 2 | 3 | 4 | 5 |
|---|---|---|---|---|---|
| 1 | 0 | 0 | 1 | 0 | 0 |
| 2 | 0 | 1 | 0 | 1 | 0 |
| 3 | 0 | 0 | 0 | 1 | 0 |
| 4 | 0 | 0 | 1 | 0 | 0 |
| 5 | 0 | 1 | 0 | 0 | 0 |
| 6 | 0 | 1 | 1 | 1 | 0 |

64

| | 1 | 2 | 3 | 4 | 5 | 6 | 7 | 8 | 9 | 10 |
|---|---|---|---|---|---|---|---|---|---|---|
| 1 | 0 | 0 | 0 | 0 | 1 | 1 | 0 | 0 | 0 | 0 |
| 2 | 0 | 0 | 0 | 0 | 1 | 1 | 0 | 0 | 0 | 0 |
| 3 | 0 | 0 | 1 | 1 | 0 | 0 | 1 | 1 | 0 | 0 |
| 4 | 0 | 0 | 1 | 1 | 0 | 0 | 1 | 1 | 0 | 0 |
| 5 | 0 | 0 | 0 | 0 | 0 | 0 | 1 | 1 | 0 | 0 |
| 6 | 0 | 0 | 0 | 0 | 0 | 0 | 1 | 1 | 0 | 0 |
| 7 | 0 | 0 | 0 | 0 | 1 | 1 | 0 | 0 | 0 | 0 |
| 8 | 0 | 0 | 0 | 0 | 1 | 1 | 0 | 0 | 0 | 0 |
| 9 | 0 | 0 | 1 | 1 | 0 | 0 | 0 | 0 | 0 | 0 |
| 10 | 0 | 0 | 1 | 1 | 0 | 0 | 0 | 0 | 0 | 0 |
| 11 | 0 | 0 | 1 | 1 | 1 | 1 | 1 | 1 | 0 | 0 |
| 12 | 0 | 0 | 1 | 1 | 1 | 1 | 1 | 1 | 0 | 0 |

64

RESIDUAL IMAGE DISPLAY

TECHNICAL FIELD

The present invention relates to a residual image display device for making its light-emitting diodes emit light.

BACKGROUND ART

Japanese Patent Application Laid-Open No. Hei 8-97969 (Hereinafter referred to as Patent Document 1) discloses a scan type display device having an image scanning function. This scan type display device includes a light-emitting cell array and a light-receiving element. The light-emitting cell array is constituted with numerous light-emitting cells arranged linearly. Light radiated by the light-emitting cell, after being reflected on a surface of a shielding object, is made incident on the light-receiving element. The scan type display device turns on a plurality of light-emitting cells one by one sequentially, and scans an image based on an output of the light-receiving element. This scan type display device reads out image data stored in a memory sequentially by a predetermined amount, and on/off drives the light-emitting cell array according to the data. A user holds in a hand and swings this scan type display device, to form a two-dimensional image by a residual image effect.

However, this conventional residual image display device disclosed in the Patent Document 1 has various problems as follows.

A first problem is as follows. The conventional image display device makes the light-emitting cells emit light in sequence to perform scan processing of an image. Therefore, a size of the image to be scanned is required to be adjusted to a size of the array of the light-emitting cells. Namely, in order to make the conventional residual image display device scan an image, it is necessary to make the image into the size adjusted to an array length of the plural light-emitting cells.

A second problem is as follows. The conventional image display device makes the light-emitting cells emit light to form a two-dimensional residual image. In order for the scanned image to be viewed as one residual image, light-emission of the light-emitting cells by the scanned data is required to be completed within a time being able to be viewed as one residual image. Therefore, in order for the scanned image to be viewed as one residual image, it is necessary to make the size of the image to be scanned into equal to or smaller than a size that can be viewed as one residual image.

A third problem is as follows. The conventional residual image display device is swung with the light-emitting cell array being faced to a person to be shown. Therefore, a person who holds in hand and swings the residual image display device cannot see the light-emitting cell array. The person who holds in hand and swings the residual image display device can not check whether the scanned image is viewed as one residual image or not.

A fourth problem is as follows. In the conventional residual image display device, the light-emitting cell in a displaying part turns on. The light-emitting cell in a non-displaying part turns off. Therefore, if the conventional residual image display device scans a line drawing, a letter, or the like, light-emitting cells that turn on are small in number. Consequently, it is difficult for an observer to recognize what kind of line drawing or letter is displayed. If the behind of the person who holds in hand and waves the residual image display device is bright, the lights from the light-emitting cells are buried in the brightness of the background, and it is hard for the observer to recognize the image.

The present invention is made in view of the above problems and is to solve one of the various problems in the conventional residual image display device using a plurality of light-emitting diodes, and thereby is to obtain a residual image display device easier to use than the conventional residual image display device.

DISCLOSURE OF THE INVENTION

A residual image display device according to the present invention includes: a substantially bar-shaped housing; a plurality of light-emitting diodes arranged along a longitudinal direction of the housing; a light-emitting means for making each of the light-emitting diodes emit light individually; a light-receiving means for outputting a signal based on photoelectromotive force of each of part of light-emitting diodes among the plurality of light-emitting diodes; a scanning control means for controlling the light-emitting means to make each of the light-emitting diodes emit light which is positioned neighboring the each of part of light-emitting diodes that the light-receiving means outputs the signal based on the photoelectromotive force of, and for controlling the light-receiving means to output the signal in the light-emitting state; a generating means for generating two-dimensional residual image data of the plurality of light-emitting diodes, based on the signals which are outputted from the light-receiving means and which are based on the photoelectromotive force of the part of light-emitting diodes; a storing means for storing the two-dimensional residual image data; and a light-emission control means for controlling the light-emitting means to make the plurality of light-emitting diodes emit light based on the two-dimensional residual image data stored in the storing means, in accordance with swinging of the housing.

When this structure is adopted, under control of the scanning control means, the light-receiving means outputs the signal based on the photoelectromotive force of part of light-emitting diodes among the plural light-emitting diodes, and the generating means generates two-dimensional residual image data of the plural light-emitting diodes arranged along the longitudinal direction of the housing, based on the signals which are outputted from the light-receiving means and which are based on the photoelectromotive force of part of light-emitting diodes. The light-emission control means makes the plural light-emitting diodes emit light based on the two-dimensional residual image data. Therefore, the residual image display device according to the present invention can scan an image by part of light-emitting diodes among the plural light-emitting diodes, and emit light by the plural light-emitting diodes based on an enlarged image.

Another residual image display device according to the present invention includes: a substantially bar-shaped housing; a plurality of light-emitting diodes arranged along a longitudinal direction of the housing; a light-emitting means for making each of the plurality of light-emitting diodes emit light individually; a light-receiving means for outputting a signal based on photoelectromotive force of each of the plurality of light-emitting diodes; a scanning control means for cotrolling the light-emitting means to make each of the light-emitting diodes emit light which is positioned neighboring the each of light-emitting diodes that the light-receiving means outputs the signal based on the photoelectromotive force of, and for controlling the light-receiving means to output the signal in the light-emitting state; a generating means for generating two-dimensional residual image data of part of light-emitting diodes among the plurality of light-emitting diodes, based on the signals which are outputted from the light-receiving means and which are based on the photoelectromotive force of the plurality of light-emitting diodes; a storing means for storing the two-dimensional residual image data; and a light-emission control means for controlling the light-emitting means to make the part of light-emitting diodes among the plurality of light-emitting diodes emit light based on the two-dimensional residual image data stored in the storing means, in accordance with swinging of the housing.

When this structure is adopted, under control of the scanning control means, the light-receiving means outputs the signal based on the photoelectromotive force of the plural light-emitting diodes, and the generating means generates two-dimensional residual image data of part of light-emitting diodes among the plural light-emitting diodes, based on the signals which are outputted from the light-receiving means and which are based on the photoelectromotive force of the plural light-emitting diodes. The light-emission control means makes part of of light-emitting diodes emit light based on the two-dimensional residual image data. Therefore, another residual image display device according to the present invention can scan an image by the plural light-emitting diodes, and emit light by part of of light-emitting diodes based on a reduced image.

A third residual image display device according to the present invention includes: a substantially bar-shaped housing; a plurality of light-emitting diodes arranged along a longitudinal direction of the housing; a light-emitting means for making the light-emitting diodes emit light individually; a light-receiving means for outputting a signal based on photoelectromotive force of each of the light-emitting diodes; a scanning control means for controlling the light-emitting means to make each of the light-emitting diodes emit light which is positioned neighboring the each of the light-emitting diodes that the light-receiving means outputs the signal based on the photoelectromotive force of, and for controlling the light-receiving means to output the signal in the light-emitting state; a generating means for generating two-dimensional residual image data used for light-emission control of the light-emitting diodes, based on the signals which are outputted from the light-receiving means and which are based on the photoelectromotive force of the light-emitting diodes; a storing means for storing the two-dimensional residual image data; and a light-emission control means for controlling the light-emitting means to make the plurality of light-emitting diodes emit light based on the two-dimensional residual image data stored in the storing means, in accordance with swinging of the housing, wherein the light-emission control means controls light emission so that a light-emission period of the light-emitting diodes based on the two-dimensional residual image data is equal to or less than 1/30 second.

When this structure is adopted, the third residual image display device according to the present invention displays an image, regardless of a size of the scanned image, so that the light-emission period for the entire thereof becomes equal to or less than 1/30 second. Therefore, the entire of the scanned image is viewed as one residual image.

The above-described residual image display device according to each invention includes, in addition to the structure of each invention, a detecting means for detecting a change of a swing direction of the housing, and, with using a timing when the detecting means detects the change of the swing direction as a standard timing, after only a period from a finishing timing of last light-emission of the light-emitting diodes by the two-dimensional residual image data to the timing when the detecting means detects the change of the swing direction is passed, the light-emission control means starts light-emission of the light emitting diodes by the two-dimensional residual image data.

When this structure is adopted, at a time that the residual image display device is repeatedly swung toward right and left, the residual image formed in a period of each swinging is formed at a substantially fixed position in a space. Therefore, positions where the residual images are formed are refrained from being displaced in every swinging, so that it becomes easy to view the image.

A fourth residual image display device according to the present invention includes: a substantially bar-shaped housing; a plurality of light-emitting diodes arranged along a longitudinal direction of the housing; a plurality of back face light-emitting diodes arranged along the longitudinal direction of the housing, in a back face of the housing that is a reverse-side of the plurality of light-emitting diodes; a light-emitting means for making the light-emitting diodes and the back face light-emitting diodes emit light individually; a light-receiving means for outputting a signal based on photoelectromotive force of each of the plurality of light-emitting diodes; a scanning control means for controlling the light-emitting means to make each of the light-emitting diodes emit light which is positioned neighboring the each of the light-emitting diodes that the light-receiving means outputs the signal based on the photoelectromotive force of, and for controlling the light-receiving means to output the signal in the light-emitting state; a generating means for generating two-dimensional residual image data used for light-emission control of the light-emitting diodes, based on the signals which are outputted from the light-receiving means and which are based on the photoelectromotive force of the light-emitting diodes; a storing means for storing the two-dimensional residual image data; and a light-emission control means for controlling the light-emitting means to make the plurality of light-emitting diodes and the back face light-emitting diodes emit light based on the two-dimensional residual image data stored in the storing means, in accordance with swinging of the housing.

When this structure is adopted, in a state that the plural light-emitting diodes face an observer side, the plural back face light emitting-diodes face the user. Consequently, by observing the residual image by these plural back face light emitting-diodes, the user swinging the residual image display device can check whether the image is displayed in a desired state or not by light-emission of the plural light-emitting diodes.

A fifth residual image display device according to the present invention includes: a substantially bar-shaped housing; a plurality of light-emitting diodes arranged along a longitudinal direction of the housing; a plurality of different color light-emitting diodes emitting light of a color different from that of the plurality of light-emitting diodes, being arranged correspondingly to each of the plurality of light-emitting diodes; a light-emitting means for making the light-emitting diodes and the different color light-emitting diodes emit light individually; a light-receiving means for outputting a signal based on photoelectromotive force of each of the light-emitting diodes; a scanning control means for controlling the light-emitting means to make each of the light-emitting diodes emit light which is positioned neighboring the each of the light-emitting diodes that the light-receiving means outputs the signal based on the photoelectromotive force of, and for controlling the light-receiving means to output the signal in the light-emitting state; a generating means for generating two-dimensional residual image data used for light-emission control of the light-emitting diodes, based on the signals which are outputted from the light-receiving means and which are based on the photoelectromotive force of the light-emitting diodes; a storing means for storing the two-dimensional residual image data; and a light-emission control means for controlling the light-emitting means to make the plurality of light-emitting diodes emit light based on the two-dimensional residual image data stored in the storing means, and controlling the light-emitting means to make the plurality of different color light-emitting diodes corresponding to each of the light-emitting means which does not emit light, in accordance with swinging of the housing.

When this structure is adopted, at a time that the light-emitting diode does not emit light, the different color light-emitting diode corresponding thereto emits light. By this light emission of the different color light-emitting diode, a background of the image is formed. Therefore, if a line drawing, a letter or the like is displayed, an observer can easily view what kind of image is being displayed by a contrast between a color of the light-emitting diode and a color of the different color light-emitting diode. Consequently, even if a back of the user swinging the residual image display device is slightly bright, the observer standing face to face can view and recognize the image accurately based on the difference between the color of the background and the color of the image.

In the fifth residual image display device according to the present invention, in addition to the above-described structure of the invention, the scanning control means controlling, instead of to make each of the light-emitting diodes emit light which is positioned neighboring the each of the light-emitting diodes to perform scanning, to make each of the different color light-emitting diodes emit light which is positioned neighboring the each of the light-emitting diodes to perform scanning, and for controlling to make the each of light-emitting diodes receive reflected light of the light.

When this structure is adopted, at a time of image scanning, the light-emitting diode is required to perform scanning only.

BEST MODE FOR CARRYING OUT THE INVENTION

Hereinafter, residual image display devices according to embodiments of the present invention will be described with reference to the drawings.

Embodiment 1

Figure 1:
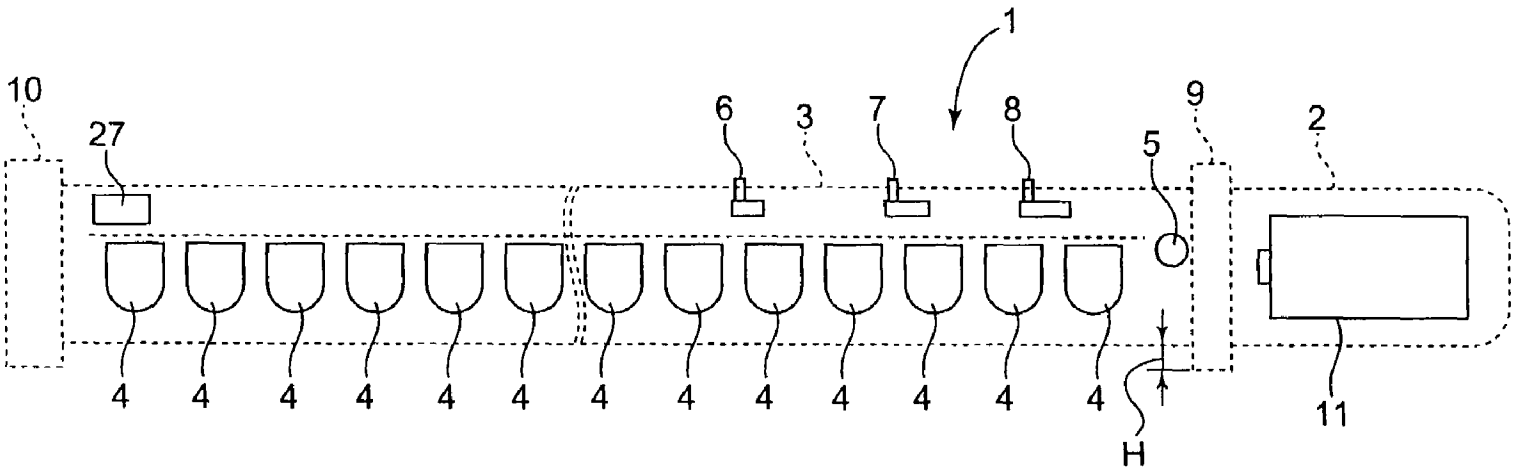
FIG. 1 is a transparent view showing a residual image display device according to a first embodiment of the present invention.

FIG. 1 is a transparent view in which a residual image display device according to a first embodiment of the present invention is seen from a side.

The residual image display device includes a housing 1. The housing 1 is formed in a substantially cylindrical elongated bar shape. The housing 1 is formed approximately 20 cm to 60 cm in length. At an end in a longitudinal direction of the housing 1, a grip section 2 for being held in hand is disposed. The residual image display device is used in a state that this grip section 2 is held in hand and is swung side to side.

Inside the grip section 2, a later-described battery 11 is disposed. Because of weight of the battery 11, the center of gravity of the residual image display device is located near the grip section 2. Therefore, when the grip section 2 is held in hand and swung, the residual image display device gives a feeling of a light swing weight to a user.

Hereinafter, a section from the other end in the longitudinal direction of the housing 1 to the grip section 2 is called a tip section 3 of the residual image display device. In this tip section 3, along the longitudinal direction of the residual image display device, a plurality of light-emitting diodes 4 are arranged in a row. A side of the housing 1 on which these plural light-emitting diodes 4 are arranged is a front face side (lower side in FIG. 1) of the respective light-emitting diodes 4, and is a front face side of the residual image display device.

The light-emitting diodes 4 emit light, by anodes having higher electric potentials than cathodes so that electric currents flow inside. The higher the electric potentials of the anodes become than the electric potentials of the cathodes, the larger quantity of electric currents flow in the light-emitting diodes 4 so that the light-emitting diodes 4 emit strong light. In the first embodiment, light-emitting diodes that emit red light are used as the light-emitting diodes 4.

Photoelectric conversion characteristic of the light-emitting diode 4 has reversibility. Namely, when the light-emitting diode 4 in non-emitting state receives incident light, the electric current corresponding to light intensity thereof flows from the anode to the cathode. As a result, a subtle voltage is excited in the light-emitting diode 4. The voltage excited in the light-emitting diodes 4 becomes larger as the light intensity of the incident light increases.

As the light-emitting diodes 4, other than the light-emitting diodes which emit red light, there are ones which emit green light, blue light, and white light and so on. It is possible to arrange the light-emitting diodes that emit light of any one color among these, instead of the ones that emit red light, in the tip section 3 of the residual image display device. Also, it is possible to combine the light-emitting diodes that emit different colors and arrange them in the tip section 3 of the residual image display device.

Between the light-emitting diodes 4 and the grip section 2, a start button 5 is disposed. On a back face side of the tip section 3 of the housing 1, there are disposed a power supply switch 6, a mode setting switch 7, and a scanning magnification setting switch 8.

Between the start button 5 and the grip section 2, a circular ring member 9 is disposed. The circular ring member 9 is formed in a donut shape having a circular outer shape and a circular inner shape. The housing 1 is inserted into the circular inner shape. The circular ring member 9 is rotatable around the housing 1. An outer circumference of the circular ring member 9 is slightly larger than the outer shape of the housing 1.

At a tip of the housing 1, a disk member 10 is rotatably disposed. An outer circumference of the disk member 10 is substantially the same as the outer circumference of the circular ring member 9. Namely, the outer circumference of the circular ring member 9 is slightly larger than the outer shape of the housing 1.

Since these circular ring member 9 and disk member 10 are provided, in a state that the residual image display device is put on a desk and the like, the circular ring member 9 and the disk member 10 come in contact with a surface of the desk. When the residual image display device is moved on the desk, the circular ring member 9 and the disk member 10 rotate. The housing 1 smoothly moves above the surface of the desk, keeping a fixed distance (space H shown in FIG. 1) between the surface of the desk.

The outer circumference of the circular ring member 9 and the outer circumference of the disk member 10 can preferably be made anti-slip by giving projections and depressions as to be like a pear surface or by applying an adhesive tape. When the residual image display device is moved on the surface of the desk, slippage between the surface of the desk and the circular ring member 9 as well as the disk member 10 becomes eliminated or decreases. As a result, rotation quanta of the circular ring member 9 and the disk member 10 become completely equal to or substantially the same as a distance which the residual image display device moves on the surface of the desk.

Figure 2:
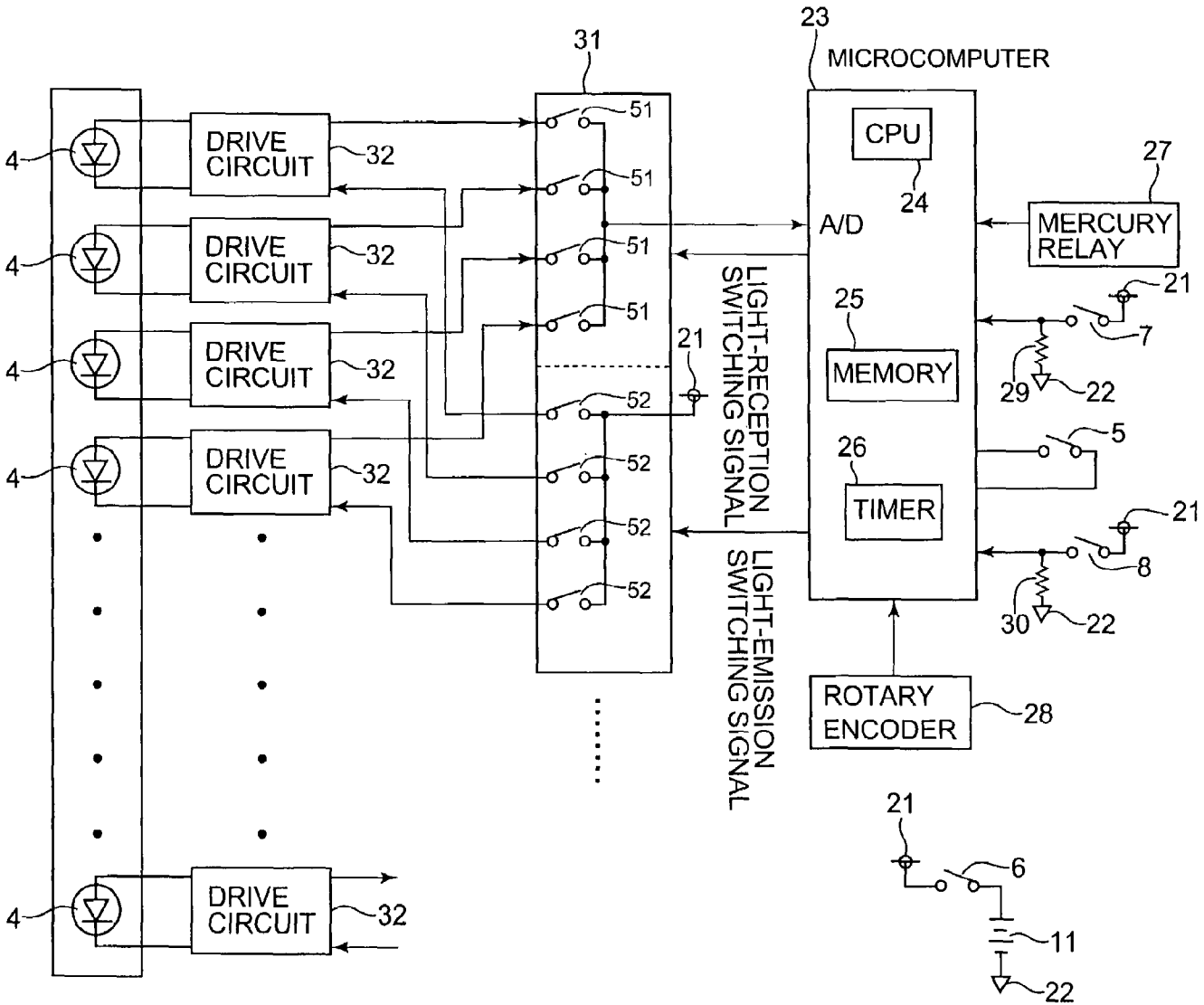
FIG. 2 is a circuit diagram showing an electric circuit which controls a plurality of light-emitting diodes and which is disposed inside the residual image display device of FIG. 1.

FIG. 2 is a circuit diagram showing an electric circuit that controls the plural light-emitting diodes 4. This electric circuit is disposed inside the residual image display device of FIG. 1.

In the electric circuit disposed inside the residual image display device, the power supply switch 6 is connected between a plus electrode of the battery 11 and a power supply line 21. A minus electrode of the battery 11 is connected to a ground line 22. In practice, the battery 11 is accommodated in an unshown battery box for replacement convenience, and this battery box is connected to the power supply switch 6 and the ground line 22. It may be carried out that the power supply switch 6 is connected between the minus electrode of the battery 11 and the ground line 22.

The electric circuit includes a microcomputer 23. The microcomputer 23 includes a central processing unit (CPU) 24, a memory 25 as a storage means, and a timer 26.

To the microcomputer 23, a mercury relay 27 as a detection means, the start button 5, the mode setting switch 7, the scanning magnification setting switch 8, and a rotary encoder 28 are connected.

The mercury relay 27 includes a cell for containing mercury, a first terminal which projects in the cell, a second terminal which projects in the cell at a position facing the first terminal, and a third terminal which projects in the cell between the first terminal and the second terminal. The mercury relay 27 is disposed at the tip of the housing 1. The mercury relay 27 is disposed in a position where a direction from the first terminal to the second terminal is along the swing direction of the residual image display device. Accordingly, for example, when the residual image display device is swung from right to left as viewed from a front, conduction between the first terminal and the third terminal is conducted by the mercury, the second terminal and the third terminal is conducted by the mercury when the residual image display device is swung from left to right as viewed from the front. The microcomputer 23 judges the swing direction of the residual image display device by detecting which of the first terminal or the second terminal the third terminal is conducted to.

Instead of this mercury relay 27, a speed sensor, a swing direction sensor or the like can be used. The swing direction sensor accommodates, for example, a ball in a cylindrical cavity, with light-emitting elements and light-receiving elements being disposed at respective ends of the cylindrical cavity. If the sensor is disposed in a position where an axial direction of the cylindrical cavity is along the swing direction of the residual image display device, when the residual image display device is swung from one side to the other side, light from the light-emitting element is blocked by the ball having moved to the one side and a light-receiving signal is not obtained from the light-receiving element of the one side. On the other hand, when the residual image display device is swung from the other side to the one side, the ball having moved to the other side blocks light from the light-emitting element and a light-receiving signal is not obtained from the light-receiving element of the other side. The microcomputer 23 judges the swing direction of the residual image display device by detecting which light reception of these two light-receiving elements is blocked.

Both ends of the start button 5 are connected to the microcomputer 23. The microcomputer 23 detects whether conduction between two terminals connected to the start button 5 is conducted or not, to detect whether the start button 5 is pressed or not.

One end of the mode setting switch 7 is connected to the microcomputer 23. The other end of the mode setting switch 7 is connected to the power supply line 21. Between the one end of the mode setting switch 7 and the ground line 22, a resistance element 29 is connected. When the mode setting switch 7 becomes in ON state, a voltage of the power supply line 21, i.e. a high-level is inputted to the microcomputer 23. When the mode setting switch 7 becomes in OFF state, a voltage of the ground line 22, i.e. a low level is inputted to the microcomputer 23. The microcomputer 23 judges two modes by judging the level of the voltage inputted from this mode setting switch 7. In the first embodiment, the microcomputer 23 judges a case of the high level as a scanning mode and judges a case of the low level as a light-emitting mode.

One end of the scanning magnification setting switch 8 is connected to the microcomputer 23. The other end of the scanning magnification setting switch 8 is connected to the power supply line 21. Additionally, between the one end of the scanning magnification setting switch 8 and the ground line 22, a resistance element 30 is connected. When the scanning magnification setting switch 8 becomes in ON state, a high level is inputted to the microcomputer 23. When the scanning magnification switch 8 becomes in OFF state, a low level is inputted to the microcomputer 23. The microcomputer 23 judges two modes by judging the level of the voltage inputted from the scanning magnification setting switch 8. In the first embodiment, the microcomputer 23 judges a case of the high level as an enlargement mode and judges a case of the low level as a normal mode.

The rotary encoder 28 reads a rotation quantity of the disk member 10. Every time the rotation quantity of the disk member 10 becomes a predetermined rotation angle, a pulse is outputted. This pulse is inputted to the microcomputer 23. The microcomputer 23 judges the rotation quantity of the disk member 10 by counting a number of the inputted pulses.

To the microcomputer 23, a multiplexer 31 is connected. To the multiplexer 31, a plurality of drive circuits 32 are connected. The respective drive circuits 32 are connected to the respective light-emitting diodes 4. The multiplexer 31 and the drive circuits 32 function as a light-emitting means and a light-receiving means.

Figure 3:
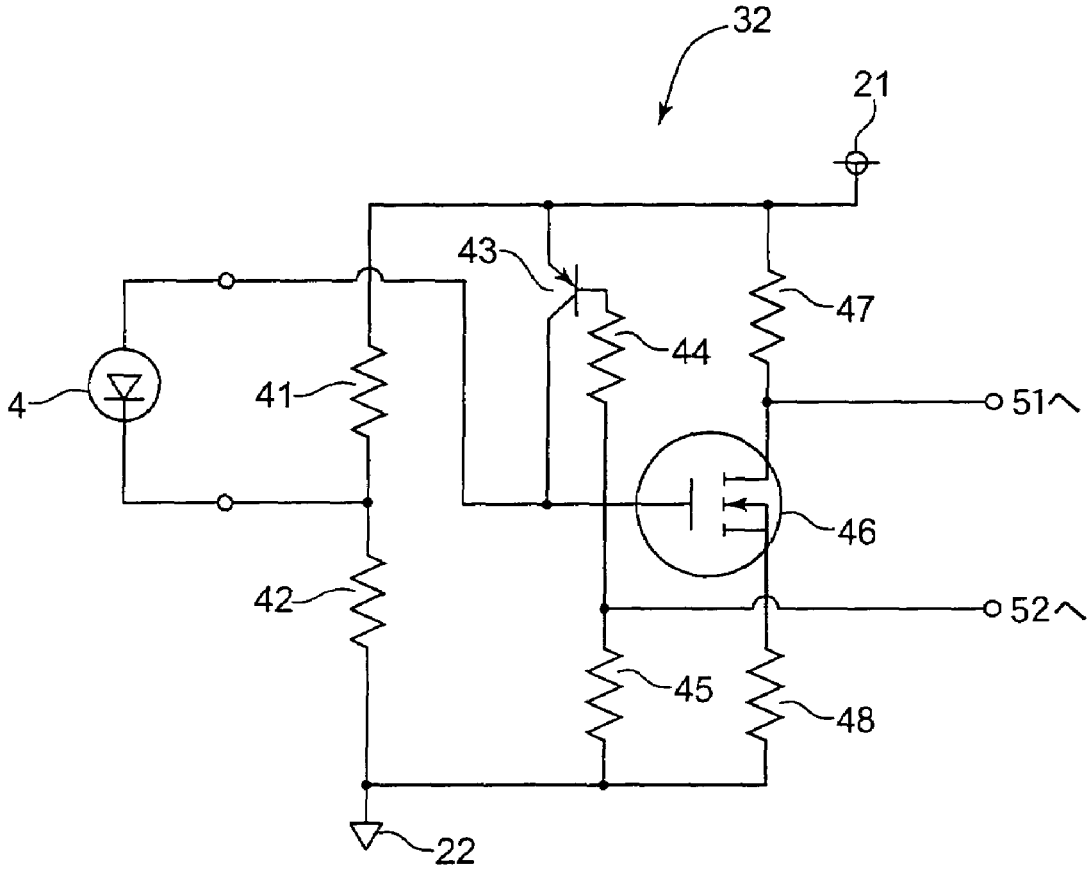
FIG. 3 is a circuit diagram showing one set of a drive circuit and the light-emitting diode in FIG. 1.

FIG. 3 is a circuit diagram showing one set of the drive circuit 32 and the light-emitting diode 4 in FIG. 1.

The drive circuit 32 includes a first voltage-dividing resistance element 41 connected to the power supply line 21, and a second voltage-dividing resistance element 42 connected between the first voltage-dividing resistance element 41 and the ground line 22. The cathode of the light-emitting diode 4 is connected between the first voltage-dividing resistance element 41 and the second voltage-dividing resistance element 42. To the anode of the light-emitting diode 4, a collector of a PNP transistor 43 is connected. An emitter of the PNP transistor 43 is connected to the power supply line 21. Between a base of the PNP transistor 43 and the ground line 22, two resistance elements 44 and 45 are connected in series. When the base of the PNP transistor 43 is controlled to the low level and the PNP transistor 43 becomes in ON state, a current flows from the PNP transistor 43 to the light-emitting diode 4, so that the light-emitting diode 4 emits red light.

To the anode of the light-emitting diode 4, a gate of a FET (Field Effect Transistor) 46 is further connected. Between a source of the FET 46 and the power supply line 21, a load resistance element 47 is connected. Between a drain of the FET 46 and the ground line 22, a resistance element 48 is connected. To the gate of the FET 46, an added voltage is applied, which is obtained by adding a voltage of the second voltage-dividing resistance element 42 and a voltage generated in the light-emitting diode 4. In the FET 46, a current flows, which is corresponding to a potential difference between this added voltage and the voltage of the ground line 22. This current generates a voltage in the load resistance element 47. When the voltage generated in the light-emitting diode 4 changes according to a change of light intensity incident on the light-emitting diode 4 in non-emitting control state, a voltage of the load resistance element 47 changes in accordance with this change.

The multiplexer 31 includes two switch arrays, as shown in FIG. 2.

One switch array of the two switch arrays is constituted with a plurality of switches 51. Respective one terminals of the plural switches 51 are connected to a common terminal. This common terminal is connected to an AD port of the microcomputer 23. The AD port converts analog data to digital data. The respective switches 51 of the one switch array are connected between the load resistance elements 47 and the sources of the FET 46 of the respective drive circuits 32. The plural switches 51 are opened/closed by a light-reception switching signal from the microcomputer 23. The switch 51 designated by the light-reception switching signal is closed. The voltage of the load resistance element 47 of the drive circuit 32 connected to the closed switch 51 is inputted to the AD port of the microcomputer 23. It should be noted that in the first embodiment the plural switches 51 of the one switch array are opened when the light-reception switching signal is not inputted.

The other switch array of the two switch arrays is constituted with a plurality of switches 52. Respective one ends of the plural switches 52 are connected to a common terminal. This common terminal is connected to the power supply line 21. The respective switches 52 of the other switch array are connected between the two resistance elements 44 and 45 of the respective drive circuits 32. The plural switches 52 are opened/closed by a light-emission switching signal from the microcomputer 23. The switch 52 designated by the light-reception switching signal is opened. The PNP transistor 43 of the drive circuit 32 connected to the opened switch 52 becomes in ON state so that the light emitting diode 4 emits light. It should be noted that in the first embodiment the plural switches 52 of the other switch array are closed when the light-reception switching signal is not inputted.

Figure 4:
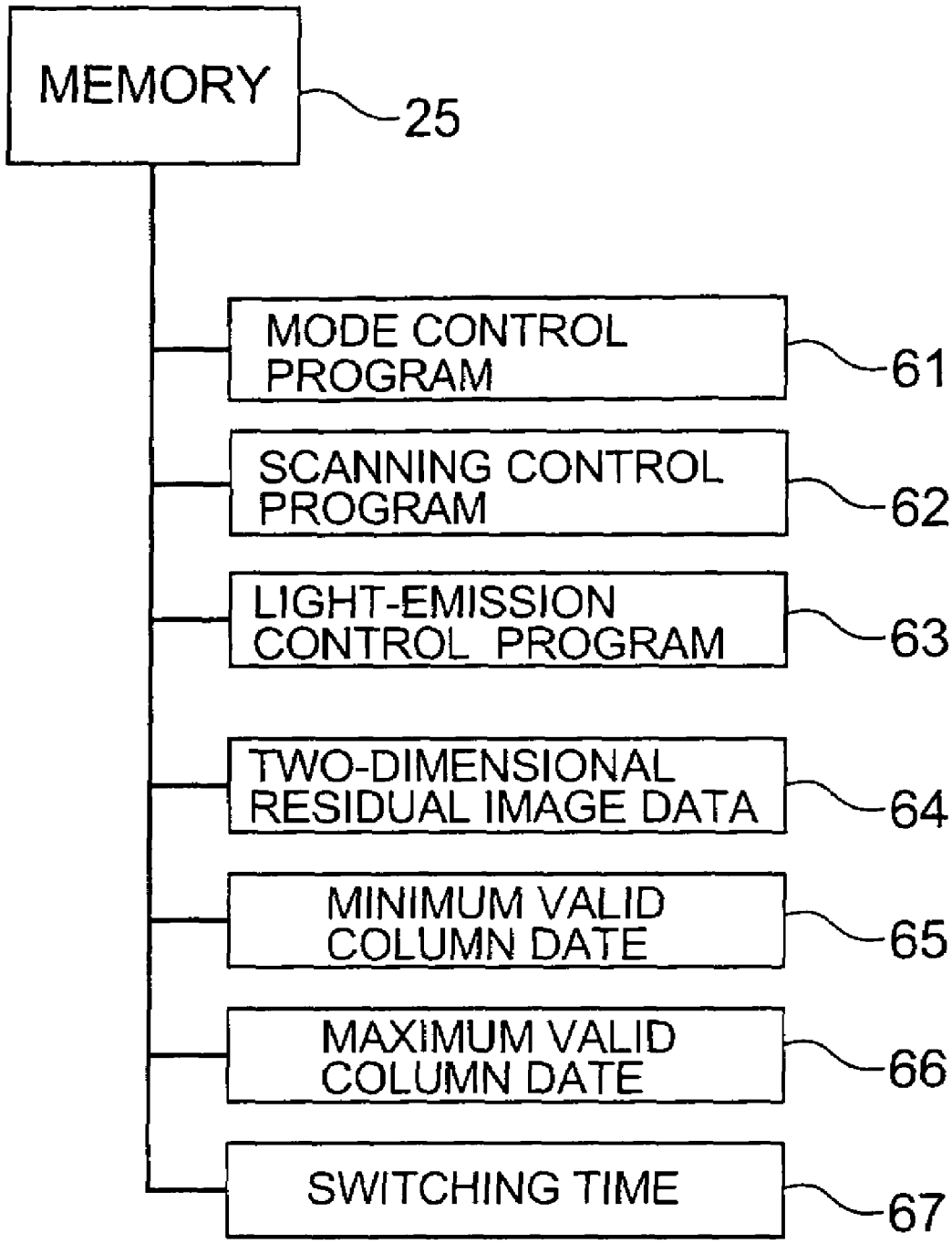
FIG. 4 is an explanatory diagram showing programs and data stored in a memory of a microcomputer in FIG. 2.

FIG. 4 is an explanatory diagram showing programs and data stored in the memory 25 of the microcomputer 23 in FIG. 2.

In the memory 25, a mode control program 61, a scanning control program 62, and a light-emission control program 63 are stored. In the memory 25, two-dimensional residual image data 64, minimum valid column data 65, maximum valid column data 66, and a switching time 67 are stored.

Next, an operation of the residual image display device structured as above will be described.

When the power supply switch 6 switches from OFF state to ON state, a voltage of the battery 11 is provided to the power supply line 21. Since the plural switches 52 of the other switch array are closed, the plural light-emitting diodes 4 do not emit light.

Electric power provided by the power supply line 21 activates the microcomputer 23. When the microcomputer 23 is activated, the central processing unit 24, after completing various internal settings, executes the mode control program 61. Accordingly, a mode control unit is realized.

Figure 5:
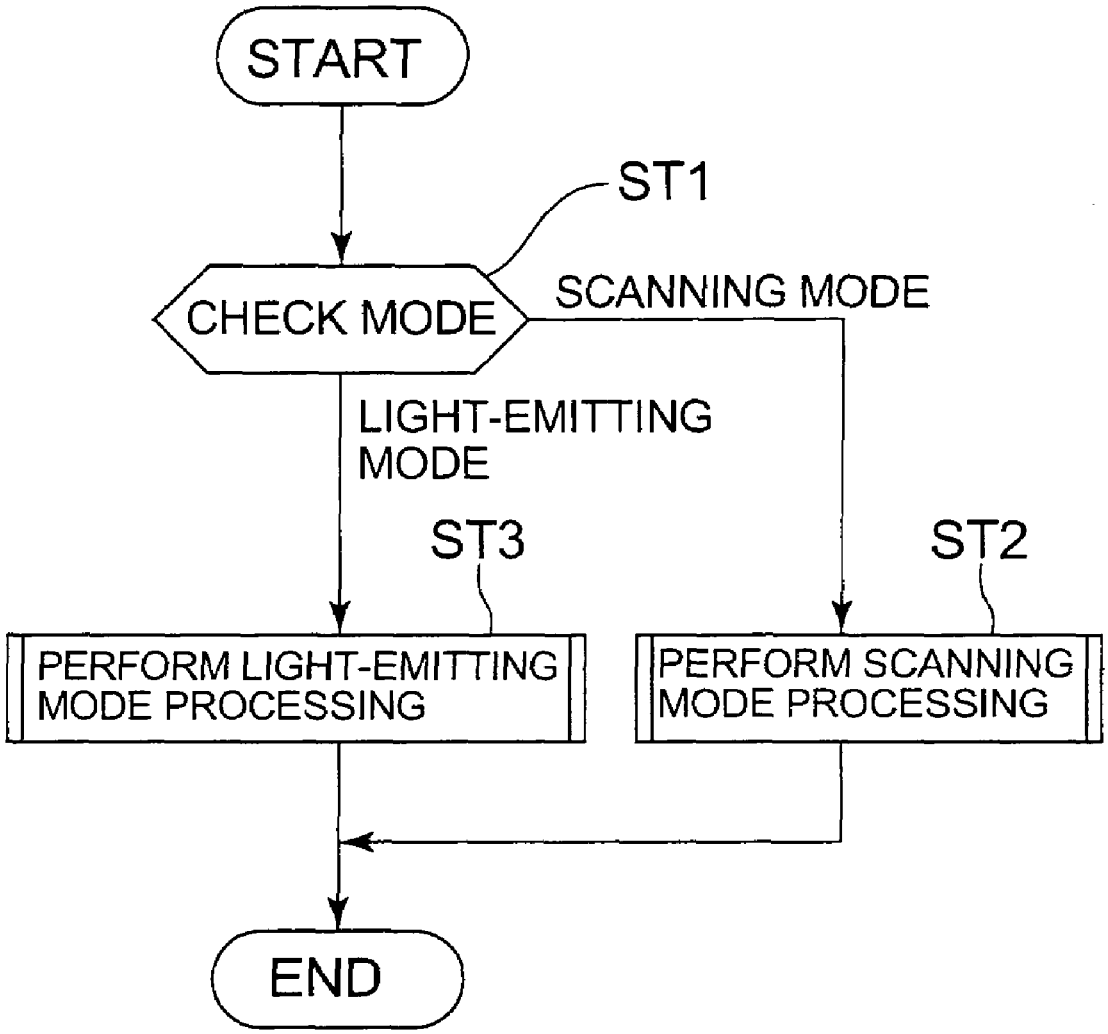
FIG. 5 is a flow chart showing control processing by a mode control unit of the first embodiment.

FIG. 5 is a flow chart showing control processing by the mode control unit.

The mode control unit judges a level of a voltage inputted from the mode setting switch 7 (ST1). If the voltage level is a high level, the mode control unit judges it as the scanning mode, and makes the central processing unit 24 execute the scanning control program 62 (ST2). If the voltage level is a low level, the mode control unit judges it as the light-emitting mode, and makes the central processing unit 24 execute the light-emission control program 63 (ST3).

Figure 6:
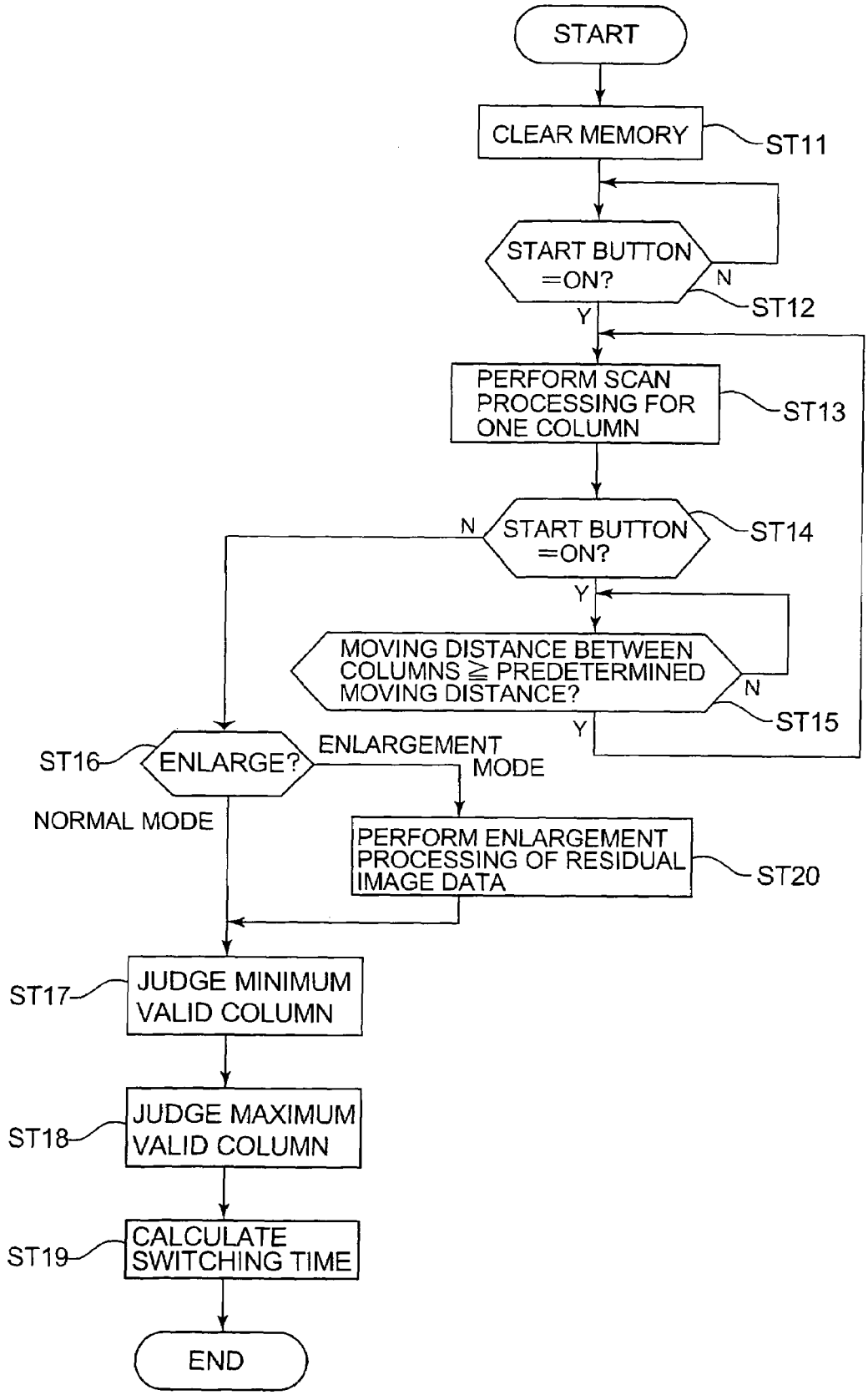
FIG. 6 is a flow chart showing control processing by a scanning control unit of the first embodiment.

By the central processing unit 24 executing the scanning control program 62, a scanning control unit which functions as a scanning control means and a generating means is realized. FIG. 6 is a flow chart showing control processing by the scanning control unit.

The scanning control unit erases data written in the two-dimensional residual image data 64, the switching time 67, the minimum valid column data 65, and the maximum valid column data 66 (ST11). Thereafter, the scanning control unit becomes in a standby state waiting for a pressing operation of the start button 5 (ST12).

Figures 7, 8:
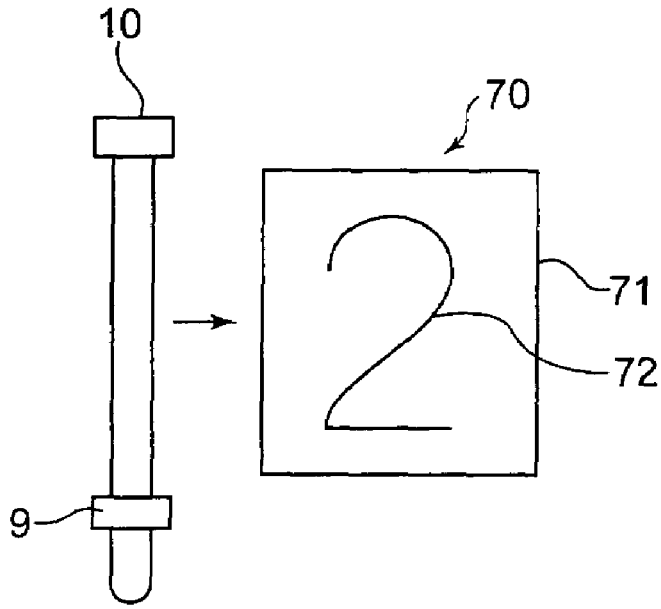
FIG. 7 is an explanatory diagram showing an example of cases that two-dimensional display data are scanned as residual image data by the residual image display device of the first embodiment.
FIG. 8 is a chart showing two-dimensional residual image data written in the memory when an image in FIG. 7 is scanned.

FIG. 7 is an explanatory diagram showing an example of cases that two-dimensional display data 70 are scanned as the residual image data 64 by the residual image display device. In the example of FIG. 7, the display data 70 is a character data 72 as a numeral "2", which is printed in black vertically on a white sheet 71, the vertical length of which is longer than the width of it. This sheet 71 and the residual image display device are placed on the surface of the desk, for example. The sheet 71 is placed in a way that a surface on which the numeral "2" is printed faces up. The residual image display device is placed on a left side in a horizontal direction of the sheet 71.

For example, a user set the scanning magnification setting switch 8 in OFF state, and then presses the start button 5. Then, the user moves the residual image display device from a left end to a right end of the sheet 71, keeping the front of the residual image display device facing down, i.e., keeping the plural light-emitting diodes 4 facing the surface of the desk. When the residual image display device has moved to a right side of the sheet 71, the start button 5 is released.

By the start button 5 being pressed, the scanning control unit starts scan processing. The scanning control unit performs scan processing of the residual light image data on a column-by-column basis (ST13).

In the scan processing of the residual light image data on a column-by-column basis, the scanning control unit first outputs the light-reception switching signal for closing the switch 51 which is connected via the drive circuit 32 to a top light-emitting diode 4 in FIG. 2, as well as outputs the light-emission switching signal for closing the switch 52 which is connected via the drive circuit 32 to a second light-emitting diode 4 from the top in FIG. 2. Accordingly, the second light-emitting diode 4 from the top in FIG. 2 emits light. The light emitted from the second light-emitting diode 4 is reflected on the sheet 71, and received by the top light-emitting diode 4 in FIG. 2. To the microcomputer 23, a voltage of a level corresponding to a received light intensity of the top light-emitting diode 4 in FIG. 2 is inputted.

A received light intensity of the light-emitting diode 4 is substantially proportionate to a reflected light intensity reflected on the sheet 71. The whiter a color of the sheet 71 is the more the reflected light intensity is, while the blacker the color of the sheet 71 is the less the reflected light intensity is. The level of the voltage inputted to the microcomputer 23 becomes lower as the color of the sheet 71 is whiter, and becomes higher as the color of the sheet 71 is blacker. The microcomputer 23, comparing this level of the voltage with a predetermined threshold level, judges the color of the sheet 71 to be black if a voltage higher than the threshold level is inputted, and writes "1" into the memory 25 as the two-dimensional residual image data 64. The microcomputer 23 judges the color of the sheet 71 to be white if a voltage lower than the threshold level is inputted, and writes "0" into the memory 25 as the two-dimensional residual image data 64. Incidentally, correspondence between the judged color and the value written into the memory 25 can be reversed. The predetermined threshold level can have been stored in the memory 25, for example.

After the value based on the received light intensity of the top light-emitting diode 4 in FIG. 2 is written into the memory 25, the scanning control unit outputs the light-reception switching signal for closing the switch 51 which is connected via the drive circuit 32 to the second light-emitting diode 4 from the top in FIG. 2, as well as outputs the light-emission switching signal for closing the switch 52 which is connected via the drive circuit 32 to the third light-emitting diode 4 from the top in FIG. 2. The scanning control unit, comparing the level of the voltage corresponding to the received light intensity of the second light-emitting diode 4 from the top in FIG. 2 with the predetermined threshold level, writes the value corresponding to the judged color into the memory 25 as the two-dimensional residual image data 64.

The scanning control unit performs the light-reception processing by the respective light-emitting diodes 4 as to all the light-emitting diodes 4. Accordingly, the same number of values as a number of the light-emitting diodes 4 is written into the memory 25 as the residual light image data for one column. Incidentally, there is no light-emitting diode 4 below the bottommost light-emitting diode 4 in FIG. 2. Therefore, when the light is to be received by the bottommost light-emitting diode 4 in FIG. 2, the second light-emitting diode 4 from the bottom in FIG. 2, for example, can be made emit light.

When scanning of the residual light image data for one column as above is completed, the scanning control unit checks whether the start button 5 is kept pressed or not (ST14), and if the start button 5 is kept pressed, the scanning control unit judges a moving-distance-between-columns of the residual image display device, based on a number of pulses inputted from the rotary encoder 28 (ST15). When the moving-distance-between-columns of the residual image display device becomes equal to or more than a predetermined moving distance, the above described scan processing of the residual light image data for one column is performed (ST13). Accordingly, into the memory 25, residual light image data of two columns in total are written. Incidentally, the predetermined moving distance can have been stored in the memory 25, for example.

The scanning control unit repeats the scan processing of the residual light image data for one column (ST13 to ST15) in the every predetermined moving-distance-between-columns, until the start button 5 become unpressed. When, in FIG. 7, the start button 5 is released at a time that the residual image display device has moved to the right side of the sheet 71, the two-dimensional residual image data 64 as shown in FIG. 8 are written into the memory 25. In an example shown in FIG. 8, the two-dimensional residual image data 64 are constituted with the residual image data for nine columns from a first column to a ninth column.

When the start button 5 becomes unpressed, the scanning control unit reads a voltage level inputted from the scanning magnification setting switch 8, and judges whether enlargement or not (ST16). On this occasion, since the scanning magnification setting switch 8 is in OFF state, the scanning control unit judges it as the normal mode based on the voltage of the low level. The scanning control unit writes the minimum valid column data 65, the maximum valid column data 66, and the switching time 67 into the memory 25 based on the two-dimensional residual image data 64 stored in the memory 25 (ST17, ST18, and ST19).

The minimum valid column data 65 are generated by procedures stated below, for example. The scanning control unit judges whether "1" is included in the column of the two-dimensional residual image data 64 or not, from the first column in order. The scanning control unit extracts a column number of the first column in the column data of which "1" is included for the first time. The scanning control unit writes this extracted column number into the memory 25 as the minimum valid column data 65. In the two-dimensional residual image data 64 in FIG. 8, "2" equivalent to the second column is written into the memory 25 as the minimum valid column data 65.

The maximum valid column data 66 are generated by procedures stated below, for example. The scanning control unit judges whether "1" is included in the column of the two-dimensional residual image data 64 or not, from the last column in order. The scanning control unit extracts a column number of the first column in the column data of which "1" is included for the first time. The scanning control unit writes this extracted column number into the memory 25 as the maximum valid column data 66. In the two-dimensional residual image data 64 in FIG. 8, "8" equivalent to the eighth column is written into the memory 25 as the maximum valid column data 66.

The switching time 67 is generated by procedures stated below, for example. The scanning control unit calculates a number of columns from the minimum valid column data 65 to the maximum valid column data 66. The scanning control unit next divides a display time of 33.3 ms (≈1/30 second) by the number of the columns. The scanning control unit writes a quotient thereof into the memory 25 as the switching time 67. In the two-dimensional residual image data 64 in FIG. 8, the minimum valid column data 65 is the second column and the maximum valid column data 66 is the eighth column. The number of the columns is 7 columns. Therefore, the scanning control unit writes 4.7 ms (≈33.3 ms÷7), for example, into the memory 25 as the switching time 67.

Figures 9, 10, 11:
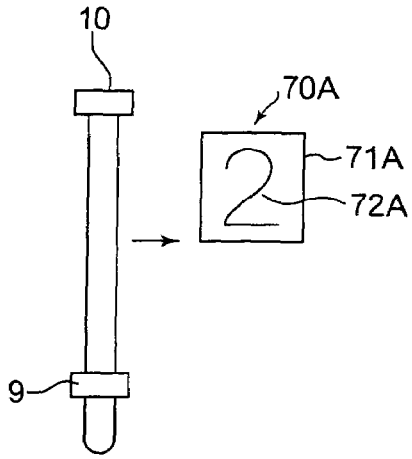
FIG. 9 is an explanatory diagram showing a case of scanning a numeral smaller than a numeral in FIG. 7.
FIG. 10 is a chart showing two-dimensional residual image data written in the memory when an image in FIG. 9 is scanned.
FIG. 11 is a chart showing two-dimensional residual image data enlarged from the two-dimensional residual image data in FIG. 10.

Next, as shown in FIG. 9, a case of scanning numerical character data 72A that is smaller in size than the numeral in FIG. 7 will be described. Also in this case, the scanning control unit performs processing based on the flow chart shown in FIG. 6. When a display data 70A being a small-sized image is scanned, the scanning magnification setting switch 8 is set to be in ON state in advance.

Thereafter, when the start button 5 is pressed (ST12), the scanning control unit starts scan processing. The scanning control unit repeats scan processing of the residual light image data on a column-by-column basis (ST13 to ST15) in every predetermined moving-distance-between-columns, until the start button 5 become unpressed.

It should be noted that, as shown in FIG. 9, only half of the plural light-emitting diodes 4 positioned nearer to the tip of the housing 1 are used for scanning based on setting of the scanning magnification setting switch 8. Incidentally, the plural light-emitting diodes 4 used for this scanning can be only the half ones nearer to the grip section 2 of the housing 1, can be only the ones in a central part of the housing 1, or can be the ones which are arranged sequentially to each other in an arrangement of the plural light-emitting diodes 4.

In FIG. 9, if the start button 5 is released at a time that the residual image display device has moved to a right side of the sheet 71A, two-dimensional residual image data 64 are written into the memory 25 as shown in FIG. 10. The two-dimensional residual image data 64 shown in FIG. 10 are constituted with residual image data of five columns from a first column to a fifth column.

When the start button 5 becomes unpressed, the scanning control unit reads a voltage level inputted from the scanning magnification setting switch 8, and judges whether enlargement or not (ST16). On this occasion, since the scanning magnification setting switch 8 is in ON state, the scanning control unit judges it as an enlargement mode based on the voltage of the high level. The scanning control unit performs enlargement processing of the scanned image (ST20). Namely, for example, the scanning control unit performs processing to double the lengths of the scanned two-dimensional residual image data 64. This means that the image becomes 4 times in size.

The processing to double the image length is realized by following processing, for example. The scanning control unit reads a last column number of the two-dimensional residual image data 64. Here, the last column number is represented by "m" ("m" is a natural number). The scanning control unit writes data of an m-th column of the read two-dimensional residual image data 64 into a (2 m−1)-th column and a 2 m-th column. Next, the scanning control unit writes data of a (m−1)-th column of the read two-dimensional residual image data 64 into a (2 m−3)-th column (=2 (m−1)−1) and a (2 m−2)-th column (=2 (m−1)). Such migration processing of the column data is performed up to a first column. Accordingly, the image by the read two-dimensional residual image data 64 is doubled in a column direction.

The scanning control unit, next, reads a last row number of the two-dimensional residual image data 64. Here, the last row number is represented by "n" ("n" is a natural number). The scanning control unit writes data of an n-th row of the read two-dimensional residual image data 64 into a (2n−1)-th row and a 2n-th row. Next, the scanning control unit writes data of a (n−1)-th row of the read two-dimensional residual image data 64 into a (2n−3)-th row (=2 (n−1)−1) and a (2n−2)-th row (=2 (n−1)). Such migration processing of the row data is performed up to a first row. Accordingly, the image by the read two-dimensional residual image data 64 is doubled in a row direction.

By the above processing, the two-dimensional residual image data 64 stored in the memory 25 become double in the image length (4 times in the image size) of the read two-dimensional residual image data 64. In this way, based on the residual image data 64 in FIG. 10, new two-dimensional residual image data 64 shown in FIG. 11 are generated. Incidentally, the two-dimensional residual image data 64 shown in FIG. 11 has substantially the same image size as the two-dimensional residual image data 64 in FIG. 8.

A magnification can be other magnifications such as a triple magnification and the like. Also, the magnification can be fixed at double, triple, or the like, and can be chosen among the fixed magnification by the user. In the above description, the processing of doubling in the row direction after doubling in the column direction is performed, but the same two-dimensional residual image data 64 can be obtained by performing the processing of doubling in the column direction after first doubling in the row direction. In the above description, enlarged two-dimensional residual image data 64 is generated only by the processing of simple migration of data, but it is possible to obtain two-dimensional residual image data 64 which has generated with after migration process such as outline processing, interpolation processing and so on.

When the enlargement processing of the image size of the read two-dimensional residual image data 64 is completed, the scanning control unit writes the minimum valid column data 65, the maximum valid column data 66, and the switching time 67 into the memory 25, based on the enlarged two-dimensional residual image data 64 stored in the memory 25 (ST17, ST18, and ST19). In the case of the two-dimensional residual image data 64 in FIG. 11, the minimum valid column data 65 is the third column, the maximum valid column data 66 is the eighth column, and the switching time 67 is 5.5 ms (≈33.3 ms÷6).

After the scanning control unit processing above process, there are stored two-dimensional residual image data 64 in the memory 25, the minimum valid column data 65, the maximum valid column data 66, and the switching time 67. When the voltage level inputted from the mode setting switch 7 is the low level, the mode control unit, judging it as the light-emitting mode, makes the central processing unit 24 execute the light-emission control program 63. By the central processing unit 24 executing the light-emission control program 63, a light-emission control unit which functions as a light-emission control means is realized.

Figure 12:
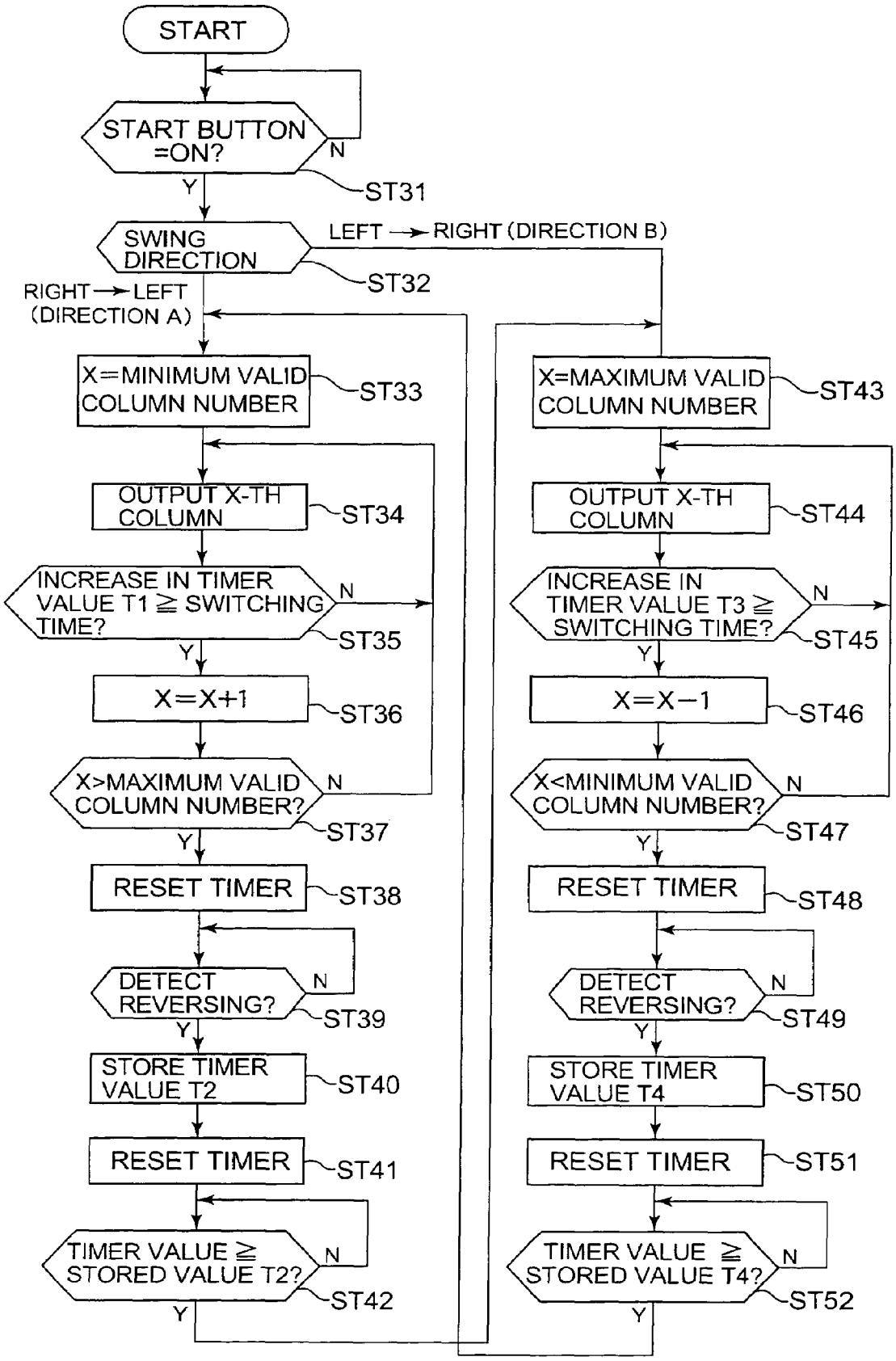
FIG. 12 is a flow chart showing control processing by a light-emission control unit of the first embodiment.

FIG. 12 is a flow chart showing control processing by the light-emission control unit. The light-emission control unit first becomes a standby state waiting for a pressing operation of the start button 5 (ST31).

Figure 13:
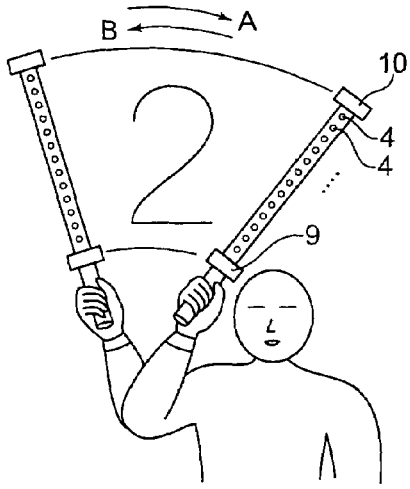
FIG. 13 is a view showing an example of use to display a residual image by using the residual image display device of the first embodiment.

FIG. 13 is a view showing an example of use to display a residual image by using the residual image display device. The user, after pressing the start button 5, holds the grip section 2 of the residual image display device in hand. The user starts waving the residual image display device with the front of the residual image display device facing in a front direction of himself. Here, the user starts to swing from a right-hand direction to a left-hand direction of himself (in an arrow direction A in FIG. 13). The user swings the residual image display device back and forth within a predetermined swing angle range by reversing the swing direction alternately, in such a way that after swinging in the direction A, swinging in an opposite direction (in an arrow direction B in FIG. 13), and further in the direction A. It should be noted that in the following description there has been stored in the memory 25 the two-dimensional residual image data 64 shown in FIG. 8.

The light-emission control unit starts light-emission processing by the start button 5 being pressed. The light-emission control unit first judges the swing direction of the residual image display device based on a continuity state of the mercury relay 27 (ST32). If the swing direction is from the right-hand direction to the left-hand direction of the user himself, the light-emission control unit performs forward light-emission processing. If the swing direction is from the left-hand direction to the right-hand direction of the user himself (in the arrow direction B in FIG. 13), the light-emission control unit performs reverse light-emission processing.

The forward light-emission processing is, for example, following processing. The light-emission control unit reads the minimum valid column data 65 stored in the memory 25 and assigns the column number of the minimum valid column data 65 to a variable "x" (ST33). The light-emission control unit reads data of an x-th column of the two-dimensional residual image data 64 and outputs a light-emission control signal for making the light-emitting diode 4 corresponding to a row having a data value "1" emit light. In the two-dimensional residual image data 64 in FIG. 8, the second row is designated as the minimum valid column data 65. Accordingly, a fourth light-emitting diode 4 from the top, a fifth light-emitting diode 4 from the top, and a twelfth light-emitting diode 4 from the top in FIG. 2 emit light (ST34).

The light-emission control unit judges, based on a value of the timer 26, whether a time T1 from a start of the above light-emission of the second column becomes equal to or more than the switching time 67 stored in the memory 25 or not. In the two-dimensional residual image data 64 in FIG. 8, whether the T1 becomes equal to or more than 4.7 ms or not is judged (ST35). When a light-emission time period of the x-th column becomes equal to or more than 4.7 ms, the light-emission control unit increments the value of the variable x by one (ST36), and judges whether this incremented value of the variable x exceeds the column number of the maximum valid column data 66 or not (ST37). The value of x at this timing is "3", being smaller than the column number ("8") of the maximum valid column data 66. Therefore, the light-emission control unit reads data of a third column of the two-dimensional residual image data 64, and outputs a light-emission control signal for making the light-emitting diode 4 corresponding to a row having a data value "1" emit light (ST34).

The light-emission control unit repeats the increment processing of the variable x and the switch processing of the light-emission control signal every time the time T1 becomes equal to or more than the switching time 67. When the value of the incremented variable x exceeds the column number of the maximum valid column data 66, the light-emission control unit ends read-out processing of the two-dimensional residual image data 64 (ST34 to ST37). In FIG. 8, at a time that the value of the variable x becomes "9", the read-out processing ends. Accordingly, during 32.9 ms (4.7 ms×7) when the value of the variable x varies from "2" to "9", the data from the second row to the eighth row of the two-dimensional residual image data 64 are read out, and based on these data light emission of the plural light-emitting diodes 4 are controlled. Consequently, by one swing in the arrow direction A in FIG. 13, as shown in FIG. 13, a person on a front face side of the user sees the numeral "2" as the residual image.

When the read-out processing of the two-dimensional residual image data 64 ends, the light-emission control unit resets the timer 26 (ST38). Thereafter, the light-emission control unit becomes in a stand by state waiting for detection of reversing (ST39). The light-emission control unit monitors the conduction state of the mercury relay 27. When the swing direction of the residual image display device is detected to be in reverse based on the conduction state of the mercury relay 27, i.e. the swing direction of the residual image display device changes from the left-hand direction to the right-hand direction of the user himself (the arrow direction B in FIG. 13), the light-emission control unit stores a value of the timer 26 at that timing into the memory 25 (ST40) and immediately resets the timer 26 (ST41). The value of the timer 26 stored in the memory 25 is a time T2 from the timer reset timing (ST38) to the detection timing of reverse. Next, the light-emission control unit monitors the value of the timer 26. When the value of the timer 26 becomes equal to or more than the value of the timer 26 stored in the memory 25, i.e. the time T2 (ST42), the light-emission control unit starts reverse light-emission processing.

The reverse light-emission processing is, for example, following processing. The light-emission control unit reads the maximum valid column data 66 stored in the memory 25 and assigns the column number of the maximum valid column data 66 to a variable "x" (ST43). The light-emission control unit reads data of an x-th column of the two-dimensional residual image data 64 and outputs a light-emission control signal for making the light-emitting diode 4 corresponding to a row having a data value "1" emit light. In the two-dimensional residual image data 64 in FIG. 8, the eighth row is designated as the maximum valid column data 66. Accordingly, the fourth light-emitting diode 4 from the top, the fifth light-emitting diode 4 from the top, the sixth light-emitting diode 4 from the top, and the twelfth light-emitting diodes 4 from the top in FIG. 2 emit light (ST44).

The light-emission control unit judges, based on the value of the timer 26, whether a time T3 from a start of the above light-emission of the eighth column becomes equal to or more than the switching time 67 stored in the memory 25 or not. In the two-dimensional residual image data 64 in FIG. 8, whether the T3 becomes equal to or more than 4.7 ms or not is judged (ST45). When a light-emission time period of the x-th column becomes equal to or more than 4.7 ms, the light-emission control unit decrements the value of the variable x by one (ST46), and judges whether this decremented value of the variable x is smaller than the column number of the minimum valid column data 65 or not (ST47). A value of x at this timing is "7", being larger than the column number "2" of the minimum valid column data 65. Therefore, the light-emission control unit reads data of a seventh column of the two-dimensional residual image data 64, and outputs a light-emission control signal for making the light-emitting diode 4 corresponding to a row having a data value "1" emit light (ST44).

The light-emission control unit repeats the decrement processing of the variable x and the switch processing of the light-emission control signal every time the time T3 becomes equal to or more than the switching time 67. When the value of the decremented variable x becomes smaller than the column number of the minimum valid column data 65, the light-emission control unit ends read-out processing of the two-dimensional residual image data 64 (ST44 to ST47). In FIG. 8, at a time that the value of the variable x becomes "1", the read-out processing ends. Accordingly, during 32.9 ms (4.7 ms×7) when the value of the variable x varies from "8" to "1", the data from the eighth row to the second row of the two-dimensional residual image data 64 are read out, and based on these data the plural light-emitting diodes 4 are light-emission controlled. Consequently, by one swing in the arrow direction B, as shown in FIG. 13, the person on the front face side of the user sees the numeral "2" as the residual image.

When the read-out processing of the two-dimensional residual image data 64 ends, the light-emission control unit resets the timer 26 (ST48). Thereafter, the light-emission control unit becomes in a standby state waiting for detection of reversing (ST49). The light-emission control unit monitors the conduction state of the mercury relay 27. When the swing direction of the residual image display device is detected to be reversed based on the conduction state of the mercury relay 27, i.e. the swing direction of the residual image display device changes from the right-hand direction to the left-hand direction of the user himself, the light-emission control unit stores a value of the timer 26 at that timing into the memory 25 (ST50) and immediately resets the timer 26 (ST51). The value of the timer 26 stored in the memory 25 at this time is a time T4 from the timer reset timing (ST48) to detection timing of reverse. Next, the light-emission control unit monitors the value of the timer 26. When the value of the timer 26 becomes equal to or more than the time T4 being the value of the timer 26 stored in the memory 25 (ST52), the light-emission control unit performs the forward light-emission processing.

As described above, in the residual image display device of the first embodiment, by being swung from the right-hand direction to the left-hand direction of the user himself (the arrow direction A in FIG. 13), the light-emission control unit performs the forward light-emission processing (ST33 to ST42), as well as by being swung from the left-hand direction to the right-hand direction of the user himself (the arrow direction B in FIG. 13), the light-emission control unit performs the reverse light-emission processing (ST43 to ST52). The residual image display device repeats the forward light-emission processing and the reverse light-emission processing in accordance with the swing direction of the residual image display device. Therefore, by the user continuing swinging the residual image display device within substantially the same swing ranges as shown in FIG. 13, the light-emission control unit performs the forward light-emission processing and the reverse light-emission processing alternately, so that the residual images based on the two-dimensional residual image data 64 are repeatedly displayed.

This residual image display device of the first embodiment scans the image by part of light-emitting diodes 4 among the plural light-emitting diodes 4, and generates the two-dimensional residual image data 64 that is enlarged from the scanned image. The residual image display device controls light emission of the plural light-emitting diodes 4 by the enlarged two-dimensional residual image data 64. Therefore, the residual image display device can scan the image by part of light-emitting diodes 4 among the plural light-emitting diodes 4 and enlarge and display the image by the plural light-emitting diodes 4.

This residual image display device of the first embodiment displays the image part, i.e. an entire light-emitting part, in or less than 1/30 second, regardless of the size of the scanned image. Therefore, an entire of the scanned image is viewed as one residual image. Moreover, the residual image display device controls timing of a start of the next light-emission, by utilizing the time from ending of the image display to reversing. Therefore, even if the swing range of the repeated back and forth swinging of the residual image display device varies in every swinging, the residual image formed by every swinging is formed at a substantially fixed position in a space. Consequently, displacements of the residual images in every swinging are restrained, so that it becomes easy to view the image.

In this residual image display device of the first embodiment, in a case that the two-dimensional residual image data 64 shown in FIG. 11 are stored in the memory 25, the light-emission control unit reads out the data from the third row to the eighth row of the two-dimensional residual image data 64 during 33 ms (≈5.5.ms×6). Consequently, the residual image display device can show the person on the front face side of the user the numeral "2" as the residual image, similarly to the two-dimensional residual image data 64 shown in FIG. 8.

Figure 14:
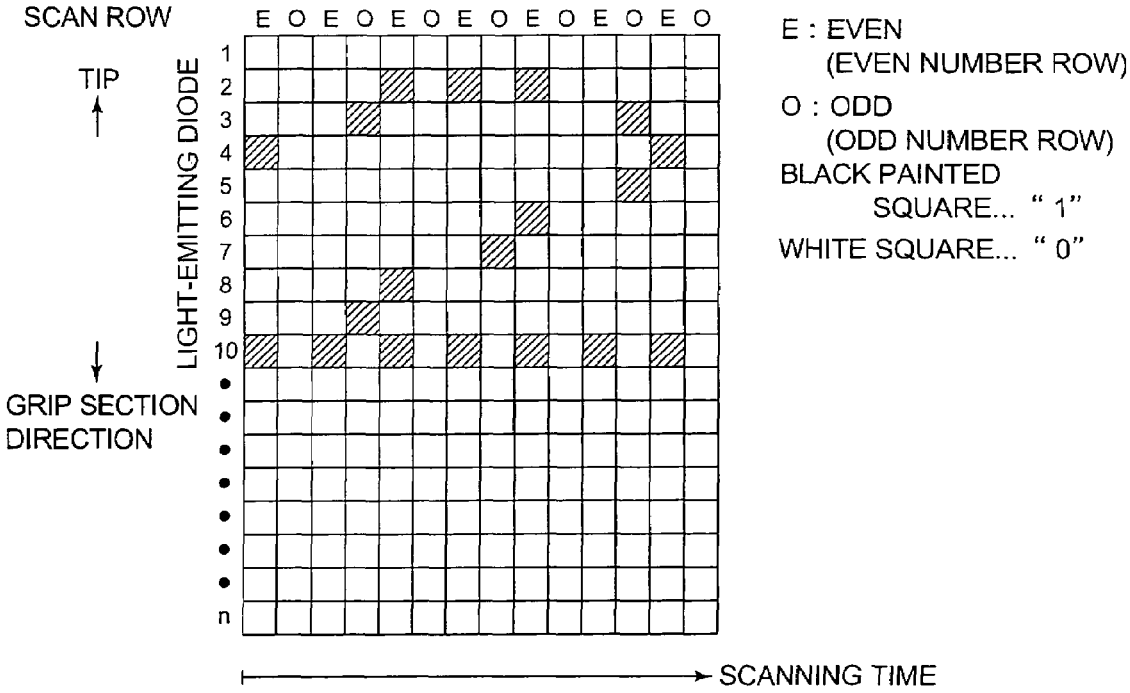
FIG. 14 is an explanatory diagram of a modification example of the residual image display device according to the first embodiment.

In this residual image display device of the first embodiment, in the scan processing of the residual light image data for one column (ST13), the scanning control unit controls the light-emitting diodes 4 one by one sequentially from the top to be in a light-receiving state, and controls the light-emitting diode 4 neighboring the light-emitting diode 4 in the light-receiving state to be in a light-emitting state. In addition to this, it is possible to control in a way, for example, as shown in FIG. 14, that the plural light-emitting diodes 4 are divided into an even ordinal number group and an odd ordinal number group, the light-emitting diodes 4 in the even ordinal number group being made into the light-receiving state while the light-emitting diodes 4 in the odd ordinal number group being made into the light-emitting state, and the light-emitting diodes 4 in the odd ordinal number group being made into the light-receiving state while the light-emitting diodes 4 in the even ordinal number group being made into the light-emitting state. Accordingly, the light-reception processing of the plural light-emitting diodes 4 can be performed simultaneously in groups, so that the scanning time of the residual light image for one column is shortened. In an example of FIG. 14, first, the light-emitting diodes 4 in the even ordinal number group are made into the light-receiving state, and next, the light-emitting diodes 4 in the odd ordinal number group are made into the light-receiving state. The black painted square corresponds to "1" and the white square corresponds to "0".

Embodiment 2

A hardware structure of a residual image display device according to a second embodiment is the same as that of the residual image display device according to the first embodiment shown in FIG. 1 to FIG. 3. In describing the hardware structure of the residual image display device according to the second embodiment, the same reference numerals and symbols as those in the hardware structure of the residual image display device according to the first embodiment shown in FIG. 1 to FIG. 3 are used and detailed description thereof will be restrained.

A microcomputer 23 in the second embodiment judges a scanning magnification setting switch 8 being in ON state as a reduction mode, based on a level of a voltage inputted from this scanning magnification setting switch 8. The microcomputer 23 judges the scanning magnification setting switch 8 being in OFF state as a normal mode, based on a level of a voltage inputted from the scanning magnification setting switch 8.

Figure 15:
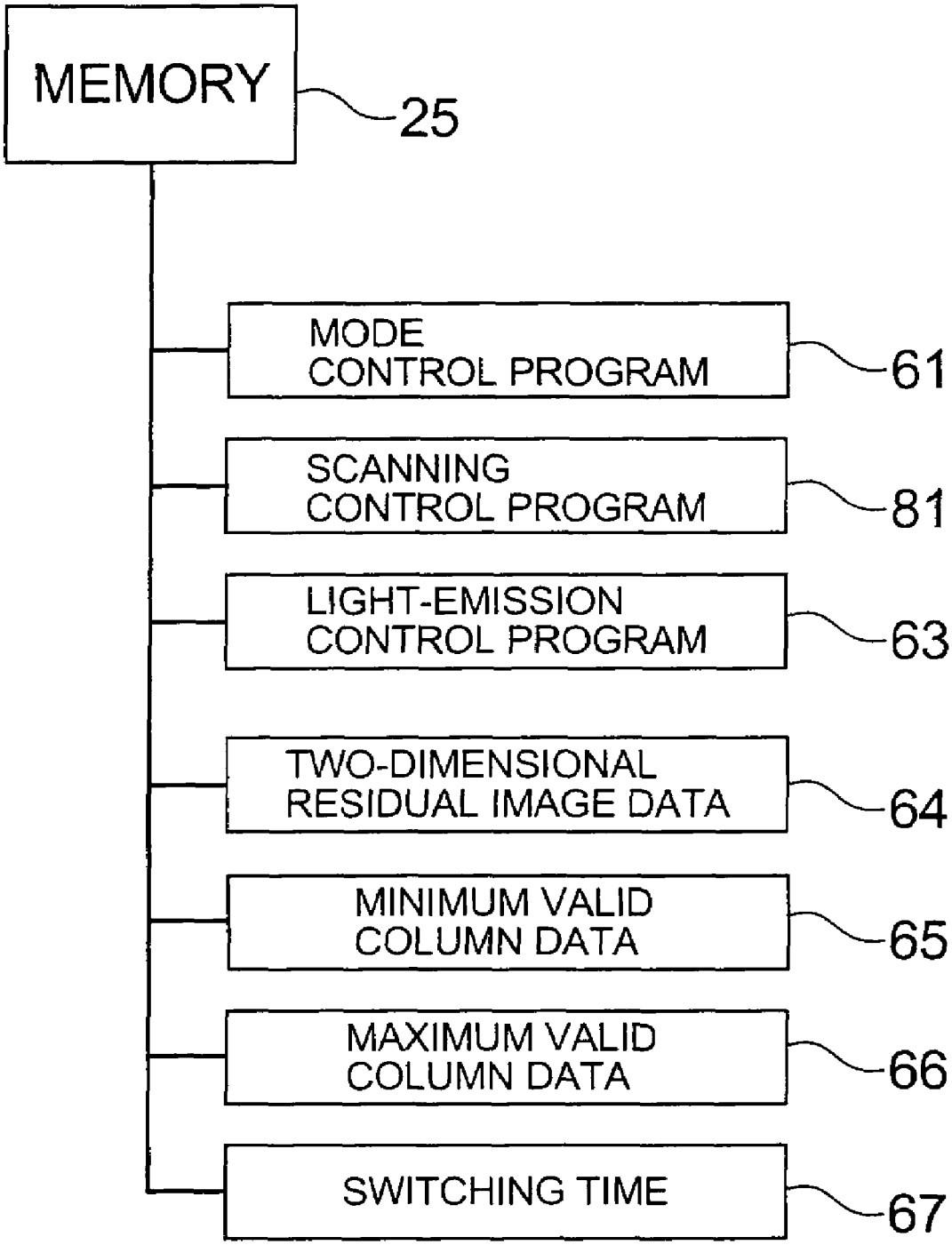
FIG. 15 is an explanatory diagram showing programs and data stored in a memory of a microcomputer of a second embodiment of the present invention.

FIG. 15 is an explanatory diagram showing programs and data stored in a memory 25 of the microcomputer 23 of the second embodiment of the present invention. In the memory 25, a mode control program 61, a scanning control program 81, and a light-emission control program 63 are stored. In the memory 25, two-dimensional residual image data 64, minimum valid column data 65, maximum valid column data 66, and a switching time 67 are stored.

By a central processing unit 24 of the microcomputer 23 executing the mode control program 61, a mode control unit is realized. By the central processing unit 24 of the microcomputer 23 executing the scanning control program 81, a scanning control unit which functions as a scanning control means and a generating means is realized. By the central processing unit 24 of the microcomputer 23 executing the light-emission control program 63, a light-emission control unit is realized. The mode control unit and the light-emission control unit according to the second embodiment execute the same control flows as those having the same names according to the first embodiment. Therefore, in the second embodiment, the same reference numerals and symbols are used to designate the programs having the same names in the first embodiment, and detailed description thereof will be restrained.

Figure 16:
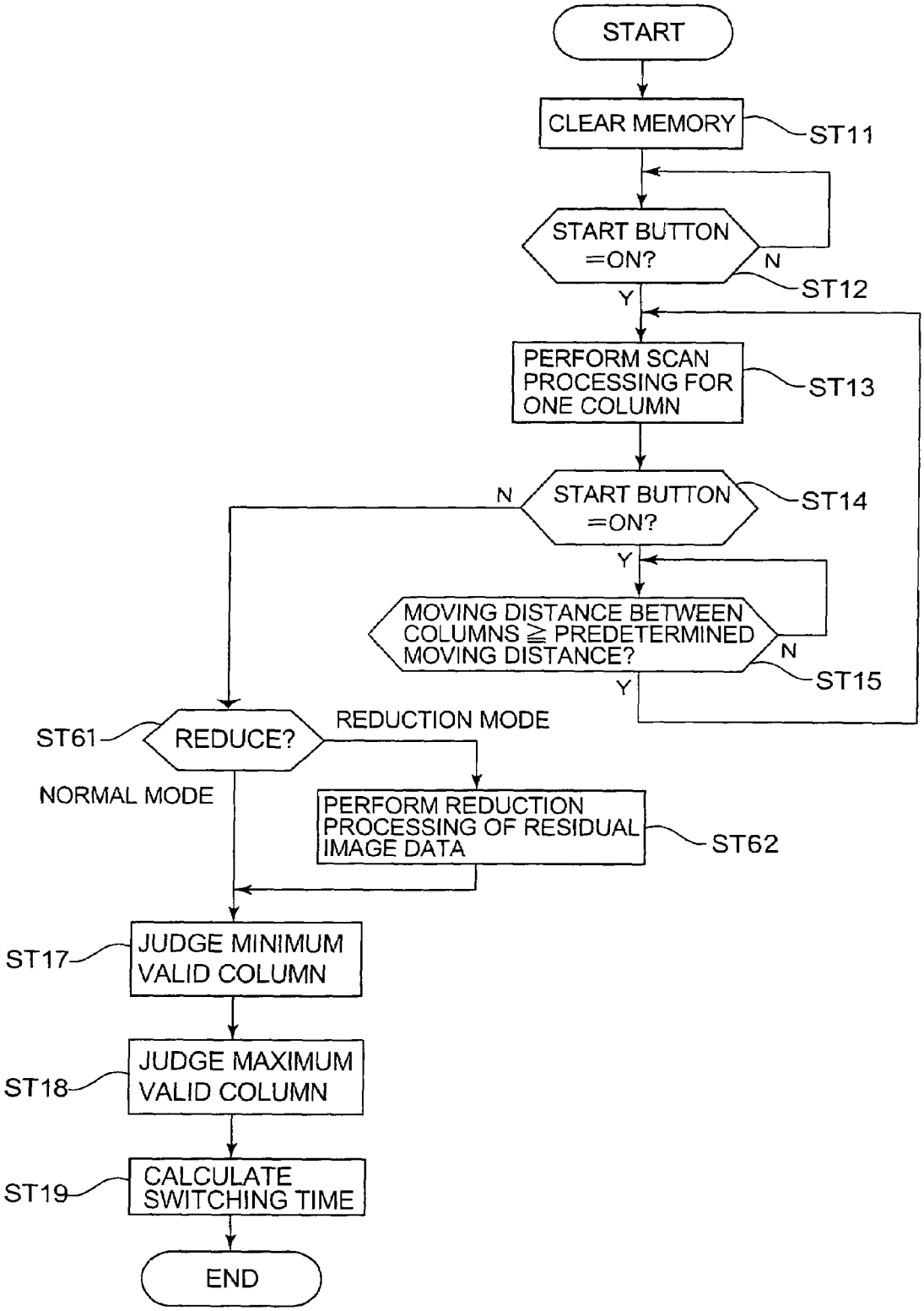
FIG. 16 is a flow chart showing control processing by a scanning control unit of the second embodiment.

FIG. 16 is a flow chart showing control processing by the scanning control unit according to the second embodiment.

The scanning control unit erases respective data of the two-dimensional residual image data 64, the minimum valid column data 65, the maximum valid column data 66, and the switching time 67, which are written in the memory 25 (ST11). Thereafter, the scanning control unit becomes in a standby state waiting for a pressing operation of the start button 5 (ST12).

By the start button 5 being pressed, the scanning control unit starts scan processing. The scanning control unit performs scan processing of the residual light image data on a column-by-column basis (ST13 to ST15). When the start button 5 becomes unpressed, the scanning control unit reads a voltage level inputted from the scanning magnification setting switch 8. On this occasion, since the scanning magnification setting switch 8 is in ON state, the scanning control unit judges it as the reduction mode based on the voltage of the high level (ST61). The scanning control unit performs the reduction processing of an image (ST62). Namely, for example, the scanning control unit performs processing to half the lengths of the scanned two-dimensional residual image data 64. This means that the image becomes quarter in size.

The processing to reduce the image size in half is realized by following processing, for example. Here, a case that the two-dimensional residual image data 64 shown in FIG. 11 are scanned will be described as an example. The two-dimensional residual image data 64 shown in FIG. 11 are data of 12 rows×10 columns. Hereinafter, when the respective data of the two-dimensional residual image data 64 are individually designated, they are stated as (n, m) data (in FIG. 11, "n" is each integer from 1 to 12, and "m" is each integer from 1 to 10). For example, statement as (2, 3) data means data of a second row and a third column.

The scanning control unit assigns "1" to a variable "x" and a variable "y", reads (x, y) data, (x, y+1) data, (x+1, y) data, and (x+1, y+1) data, then calculates an average value thereof. If the average value is equal to or more than 0.5, "1" is written into the (x, y) data. If the average value is smaller than 0.5, "0 (zero)" is written into the (x, y) data. More specifically, the scanning control unit first reads (1, 1) data, (1, 2) data, (2, 1) data, and (2, 2) data, and calculates the average value thereof. In FIG. 11, since each of the four read data is "0", the average value becomes "0" and "0" is written into the (1, 1) data.

Next, the scanning control unit adds "2" to the variable x and repeats similar average value processing. The scanning control unit repeats this until the value of the valuable x becomes equal to a number of light-emitting diodes 4 or to a value obtained by adding "1" to the number of the light-emitting diodes 4. Accordingly, a first column of the residual image data shown in FIG. 10 is stored in the memory 25.

Also, the scanning control unit adds "2" to the variable y and repeats this generation processing for one column. Accordingly, a second column of the residual image data shown in FIG. 10 is stored in the memory 25. The scanning control unit repeats this until the value of the variable y becomes equal to a column number of a last column or to a value obtained by adding "1" to the column number of the last column of the read two-dimensional residual image data 64. Accordingly, all of the residual data shown in FIG. 10 are stored in the memory 25.

By the above processing, the two-dimensional residual image data 64 stored in the memory 25 becomes half in length of the read two-dimensional residual image data 64. Accordingly, the scanning control unit can obtain data having the same size as in a case that image data of the similar size to the image of the size shown in FIG. 9 are read, based on an image of the size shown in FIG. 7. Namely, based on the residual image data 64 of the size shown in FIG. 11, there are generated the residual image data 64 of the size shown in FIG. 10. In the reduction processing, "0" is written into each part of the memory where the update data is not over written. Accordingly, all the residual image data before reduction are erased from the memory 25. A reduction ratio can be other reduction ratios such as reduction to one third and the like. The reduction ratio can be chosen among the fixed reduction ratios by the user.

The scanning control unit generates minimum valid column data 65, maximum valid column data 66, and switching time 67 of this reduced two-dimensional residual image data 64, and makes the memory 25 store them (ST17, ST18, and ST19). A control flow of the scanning control unit in a case of a normal mode is the same as that of the normal mode in the first embodiment, and description will be restrained.

The light-emission control unit controls light-emission of the plural light-emitting diodes 4 based on the two-dimensional residual image data 64 reduced as above, every time the residual image display device is swung from side to side. Accordingly, the residual image display device repeatedly displays residual images based on the reduced two-dimensional residual image data 64.

As described above, the residual image display device of the second embodiment scans the image by the plural light-emitting diodes 4 and generates the two-dimensional residual image data 64 reduced from the scanned image. The residual image display device controls light-emission of the plural light-emitting diodes 4 in part, with the reduced two-dimensional residual image data 64. Therefore, the residual image display device can scan the image by the plural light-emitting diodes 4, and reduce and display that image by part of light-emitting diodes 4 of the plural light-emitting diodes 4. Which of the plural light-emitting diodes 4 are used for emission can be freely chosen.

Embodiment 3

Figure 17:
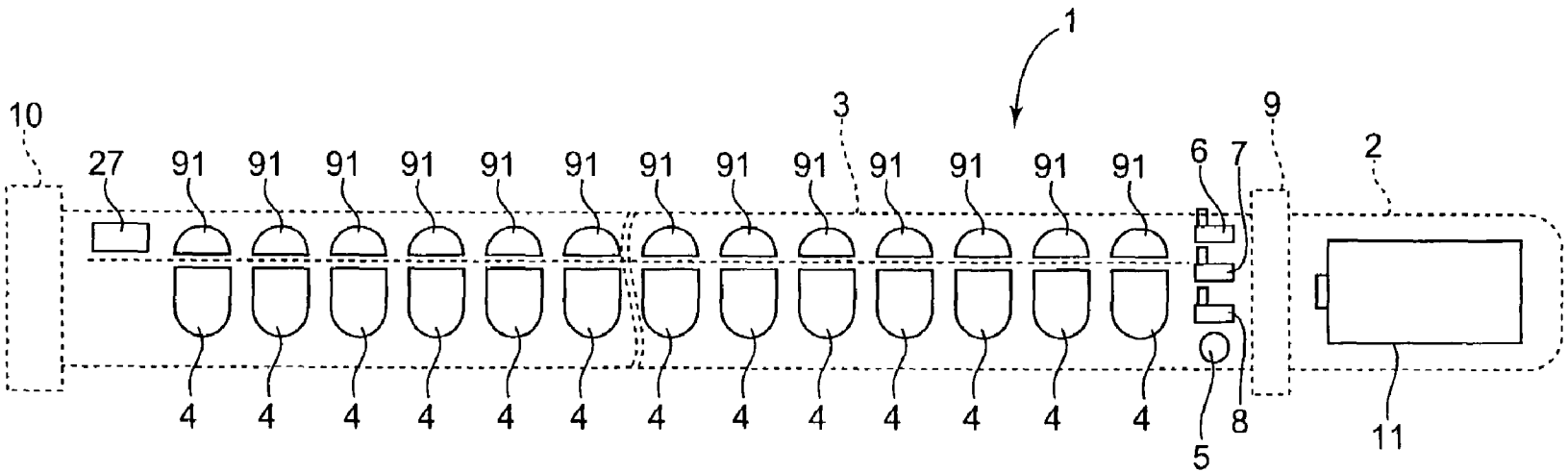
FIG. 17 is a transparent view showing a residual image display device according to a third embodiment of the present invention.

FIG. 17 is a transparent view in which a residual image display device according to a third embodiment of the present invention is seen from a side.

On a back face of a tip section 3 of the residual image display device of the third embodiment, a plurality of back face light emitting-diodes 91 are arranged in a row. In the residual image display device, since structures other than the plural light-emitting diodes 4 of back face have the same functions as in the residual image display device of the first embodiment, the same reference numerals and symbols as in the first embodiment are used and detailed description thereof will be restrained.

Figure 18:
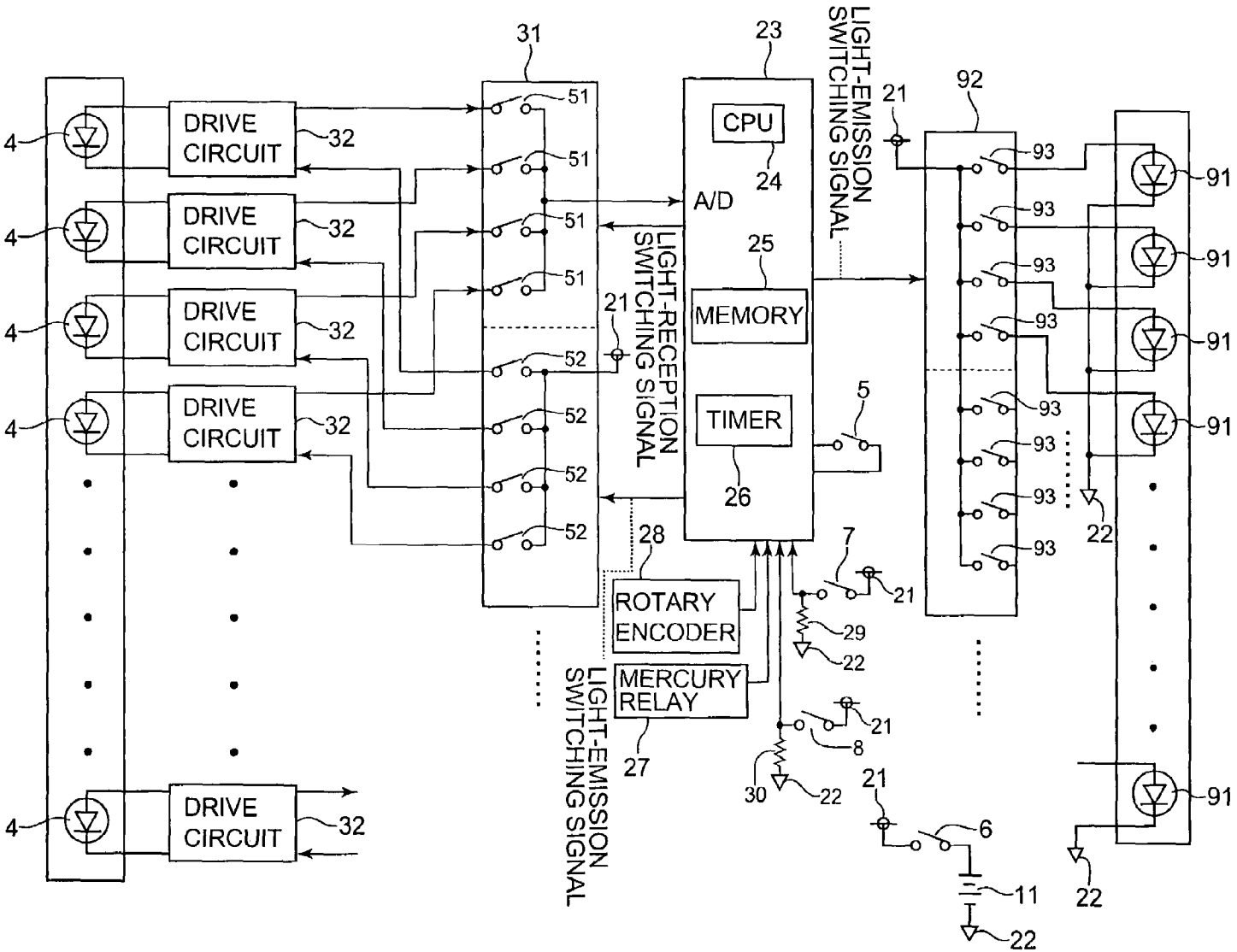
FIG. 18 is a circuit diagram showing an electric circuit controlling a plurality of light-emitting diodes of a front face and a plurality of back face light emitting-diodes of a back face, which is disposed inside the residual image display device of FIG. 17.

FIG. 18 is a circuit diagram showing an electric circuit controlling a plurality of light-emitting diodes 4 of the front face and the plural back face light emitting-diodes 91 of the back face, which is disposed inside the residual image display device of FIG. 17.

To a microcomputer 23, a second multiplexer 92 is connected. The second multiplexer 92 includes one switch array. The switch array is constituted with a plurality of switches 93. One ends of the respective plural switches 93 are connected to a common terminal. This common terminal is connected to a power supply line 21. The respective switches 93 are connected to anodes of the respective back face light-emitting diodes 91. Cathodes of the plural back face light-emitting diodes 91 are connected to a ground line 22.

The plural switches 93 are opened/closed by a back face light-emission switching signal from the microcomputer 23. The switch 93 designated by the back face light-emission switching signal is closed. The back face light emitting-diode 91 connected to the closed switch 93 emits light. The plural switches 93 of the second multiplexer 92 in the third embodiment are opened, when the back face light-emission switching signal is not inputted.

Since components of the electric circuit other than the above have the same functions as in the residual image display device of the first embodiment, the same reference numerals and symbols as those in the first embodiment are used and detailed description thereof will be restrained.

Figure 19:
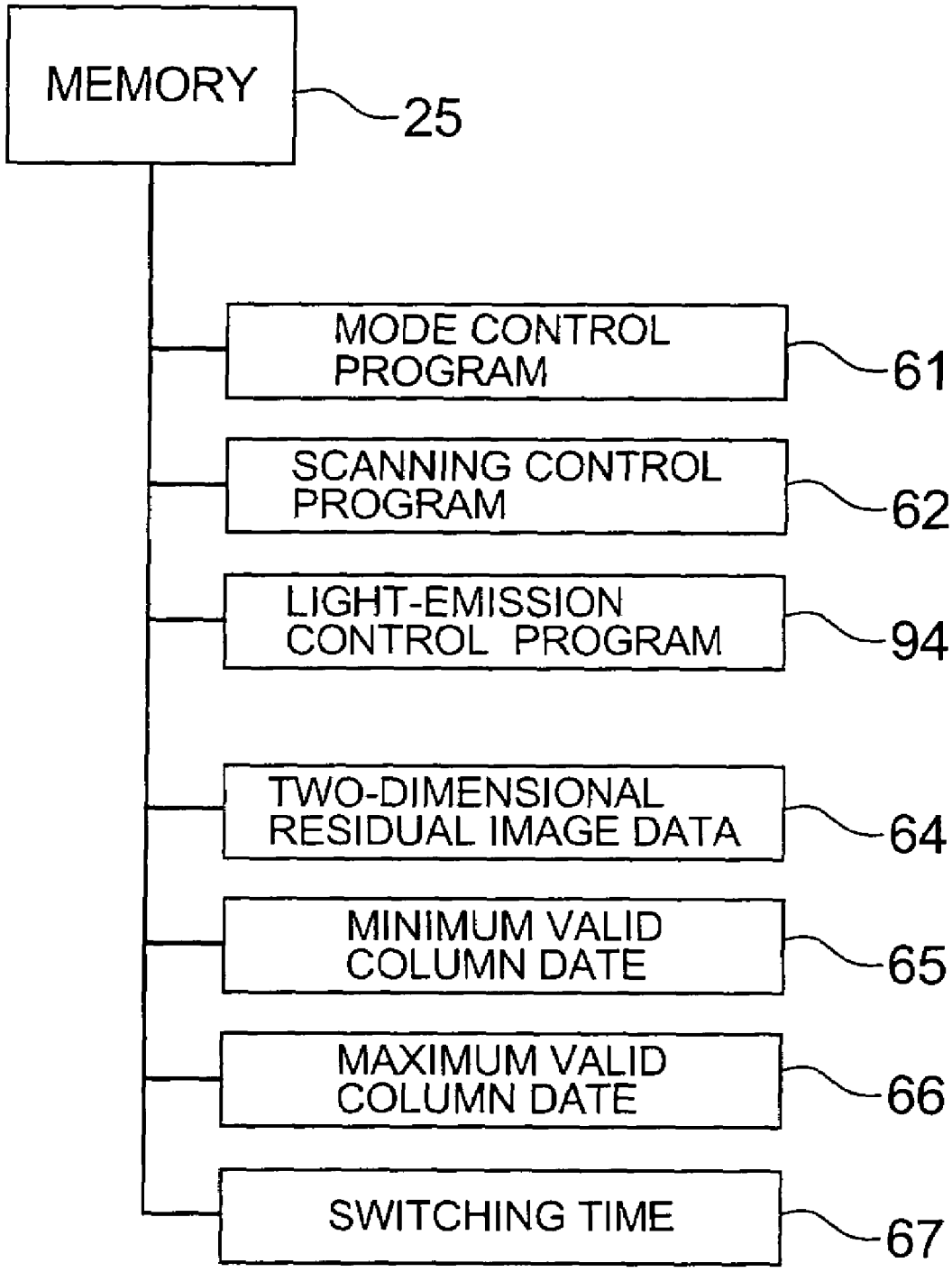
FIG. 19 is an explanatory diagram showing programs and data stored in a memory of a microcomputer in FIG. 18.

FIG. 19 is an explanatory diagram showing programs and data stored in the memory 25 of the microcomputer 23 in FIG. 18.

In the memory 25, a mode control program 61, a scanning control program 62, and a light-emission control program 94 are stored. In the memory 25, two-dimensional residual image data 64, minimum valid column data 65, maximum valid column data 66, and a switching time 67 are stored.

By a central processing unit 24 of the microcomputer 23 executing the mode control program 61, a mode control unit is realized. By the central processing unit 24 of the microcomputer 23 executing the scanning control program 62, a scanning control unit is realized. By the central processing unit 24 of the microcomputer 23 executing the light-emission control program 94, a light-emission control unit which functions as a light-emission control means is realized. The mode control unit and the scanning control unit according to the third embodiment execute the same control flows as those having the same names according to the first embodiment. In the programs and the control flows according to the third embodiment, the same reference numerals and symbols are used to the programs and steps having the same names as those in the first embodiment, and detailed description thereof will be restrained. The scanning control unit can execute the same control flow as that of the same name in the second embodiment.

Figure 20:
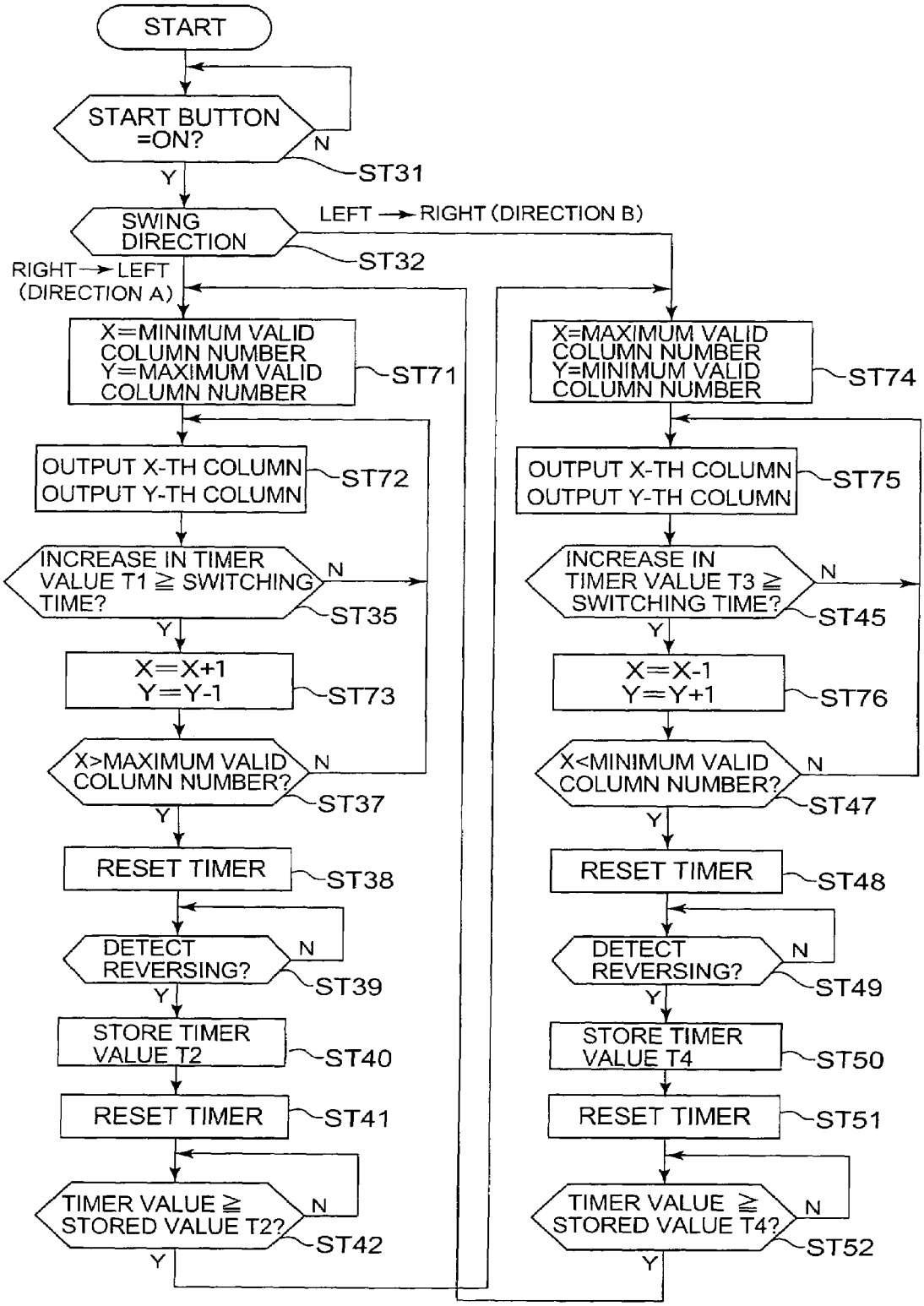
FIG. 20 is a flow chart showing control processing by a light-emission control unit of the third embodiment.

FIG. 20 is a flow chart showing control processing by the light-emission control unit. The light-emission control unit first becomes in a standby state waiting for a pressing operation of a start button 5 (ST31).

By the start button 5 being pressed, the light-emission control unit starts light-emission processing. The light-emission control unit first judges a swing direction of the residual image display device based on a conduction state of a mercury relay 27 (ST32). If the swing direction is from a right-hand direction to a left-hand direction of a user himself (in an arrow direction A in FIG. 13), the light-emission control unit performs forward light-emission processing. If the swing direction is from the left-hand direction to the right-hand direction of the user himself (in an arrow direction B in FIG. 13), the light-emission control unit performs reverse light-emission processing.

In the forward light-emission processing, the light-emission control unit assigns a column number of the minimum valid column data 65 as an initial value to a variable x, as well as assigns a column number of the maximum valid column data 66 as an initial value to a variable y (ST71). Thereafter, the light-emission control unit reads data of an x-th column of two-dimensional residual image data 64, and outputs a light-emission control signal for making the light-emitting diode 4 corresponding to a row having a data value "1" emit light. Additionally, the light-emission control unit reads data of a y-th column of the two dimensional residual image data 64, and outputs a back face light-emission control signal for making the back face light emitting-diode 91 corresponding to a row having a data value "1" emit light (ST72).

The light-emission control unit judges, based on a value of a timer 26, whether a time T1 from a start of the light-emission of the above x-th column becomes equal to or more than a switching time 67 stored in the memory 25 or not (ST35). The light-emission control unit increments the value of the variable x by one as well as decrements the value of the variable y by one (ST73). If this incremented value of the variable x exceeds the column number of the maximum valid column data 66 (ST37), the light-emission control unit ends read-out processing of the two-dimensional residual image data 64 (ST72, ST35, and ST73). If the value of the variable x does not exceed the column number of the maximum valid column data 66, the light-emission control unit continues the light-emission control by the variable x and the variable y (ST72, ST35, and ST73).

The residual image display device, based on the residual image display device being swung from the right-hand direction to the left-hand direction of the user himself, reads out data in a range from the column number of the minimum valid column data 65 to the column number of the maximum valid column data 66 of the two-dimensional residual image data 64 in a sequential order on a column-by-column basis, during a time that the value of the variable x varies from the column number of the minimum valid column number data 65 to more than the column number of the maximum valid column data 66, and based on these data, controls light-emission of the plural light-emitting diodes 4. Consequently, when the residual image display device is swung in the arrow direction A, as shown in FIG. 13, a person on a front face side of the user sees a numeral "2" as a residual image.

During a time that the value of the variable x varies from the column number of the minimum valid column number data 65 to more than the column number of the maximum valid column data 66, the value of the variable y varies from the column number of the maximum valid column data 66 to less than the column number of the minimum valid column data 65. The residual image display device reads out data in the range from the column number of the maximum valid column data 66 to the column number of the minimum valid column data 65 of the two-dimensional residual image data 64 in a sequential order on a column-by-column basis, and base on these data, controls light-emission of the plural back face light emitting-diodes 91. Consequently, when the residual image display device is swung in the arrow direction B, people on a back face side the user including the person swinging the residual image display device see the numeral "2" as the residual image. More specifically, on the back face side, the numeral "2" is displayed sequentially from right to left, and as a result "2" is displayed as the residual image.

When the read-out processing of the two-dimensional residual image data 64 ends, the light-emission control unit resets the timer 26 (ST38), detecting reversing based on a conduction state of a mercury relay 27 (ST39), and stores a time T2 being a value of a detected timing at the timer 26 into the memory 25 (ST40). The light-emission control unit resets the timer 26 (ST41), and when the value of the timer 26 becomes equal to or more than the time T2 being the value of the timer 26 stored in the memory 25, the light-emission control unit ends the forward light-emission processing (ST42), starting the reverse light-emission processing.

The reverse light-emission processing is, for example, following processing. In the reverse light-emission processing, the light-emission control unit assigns the column number of the maximum valid column data 66 as an initial value to the variable x, as well as assigns the column number of the minimum valid column data 65 as an initial value to the variable y (ST74). Thereafter, the light-emission control unit reads the data of the x-th column of the two-dimensional residual image data 64, and outputs a light-emission control signal for making the light-emitting diode 4 corresponding to a row having a data value "1" emit light. The light-emission control unit reads the data of the y-th column of the two-dimensional residual image data 64, and outputs a back face light-emission control signal for making the back face light emitting-diode 91 corresponding to a row having a data value "1" emit light (ST75).

The light-emission control unit judges, based on a value of the timer 26, whether a time T3 from a start of the light-emission of the above x-th column becomes equal to or more than a switching time 67 stored in the memory 25 or not (ST45). The light-emission control unit decrements the value of the variable x by one as well as increments the value of the variable y by one (ST76). When the value of the decremented variable x becomes less than the column number of the minimum valid column data 65 (ST47), the light-emission control unit ends the read-out processing of the two-dimensional residual image data 64 (ST75, ST45, and ST76). If the decremented value of the variable x is not less than the column number of the minimum valid column data 65, the light-emission control unit repeats the light-emission control by the variable x and the variable y (ST75, ST45, and ST76).

The residual image display device, based on the residual image display device being swung from the left-hand direction to the right-hand direction of the user himself, reads out data in a range from the column number of the maximum valid column data 66 to the column number of the minimum valid column data 65 of the two-dimensional residual image data 64 in a sequential order on a column-by-column basis, during a time that the value of the variable x varies from the column number of the maximum valid column data 66 to less than the column number of the minimum valid column data 65, and based on these data, controls light emission of the plural light-emitting diodes 4. Consequently, as shown in FIG. 13, during a time that the residual image display device is swung in the arrow direction B, the person on the front face side of the user sees the numeral "2" as the residual image.

During the time that the value of the variable x varies from the column number of the maximum valid column data 66 to less than the column number of the minimum valid column data 65, the value of the variable y varies from the column number of the minimum valid column data 65 to more than the column number of the maximum valid column data 66. The residual image display device reads out data in the range from the column number of the minimum valid column data 65 to the column number of the maximum valid column data 66 of the two-dimensional residual image data 64 in the sequential order on a column-by-column basis, and based on these data, controls light emission of the plural back face light emitting-diodes 91. Consequently, people on the back face side of the user including the user can see the numeral "2" as the residual image.

When the read-out processing of the two-dimensional residual image data 64 (ST75, ST45, and ST76) ends, the light-emission control unit resets the timer 26 (ST48), detects reversing based on the conduction state of the mercury relay 27 (ST49), and stores a time T4 being a value of a detected timing at the timer 26 into the memory 25 (ST50). The light-emission control unit resets the timer 26 (ST51), and when the value of the timer 26 becomes equal to or more than the time T4 being the value of the timer 26 stored in the memory 25, ends the reverse light-emission processing (ST52), starting the forward light-emission processing.

As described above, by the residual image display device of the third embodiment being swung from the right-hand direction to the left hand direction of the user himself, the light-emission control unit performs the forward light-emission processing, and by the residual image display device of the third embodiment being swung from the left-hand direction to the right-hand direction of the user himself, the light-emission control unit performs the reverse light-emission processing. In the residual image display device, by the user continuing swinging the residual image display device in substantially the same swing ranges as shown in FIG. 13, the light-emission control unit performs the forward light-emission processing and the reverse light-emission processing alternately, and repeatedly displays, on the front face side and the back face side, the residual images based on the two-dimensional residual image data 64.

Even when the residual image display device is swung in a state that the plural light-emitting diodes 4 face an observer side, the user swinging the residual image display device can check what image is being displayed by observing the residual image by these plural back face light emitting-diodes 91, since the plural back face light emitting-diodes 91 face himself.

Embodiment 4

Figure 21:
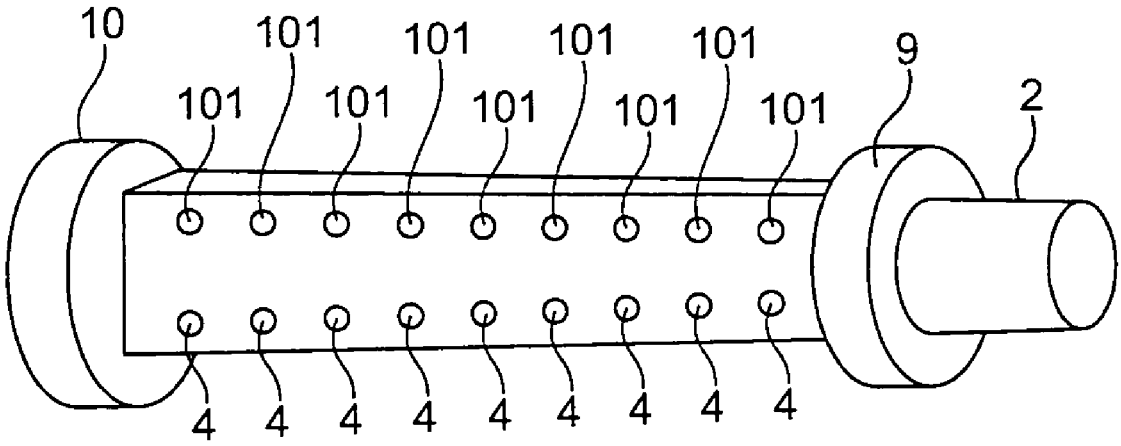
FIG. 21 is a transparent view showing a residual image display device according to a fourth embodiment of the present invention.

FIG. 21 is a perspective view showing a residual image display device according to a fourth embodiment of the present invention in a state that a housing 1 of a tip section 3 thereof is taken off.

On a front face of the tip section 3 of the residual image display device of the fourth embodiment, there are arranged a plurality of different color light-emitting diodes 101 in the other row, separately from a plurality of light-emitting diodes 4. The respective different color light-emitting diodes 101 are arranged to be one-to-one correspondent to the respective light-emitting diodes 4. The different color light-emitting diodes 101 emit blue light.

Between the tip section 3 and a grip section 2 of the residual image display device, an unshown changeover switch 103 is disposed.

Since structures other than the above have the same functions as those in the residual image display device of the first embodiment, the same reference numerals and symbols as in the first embodiment are used and detailed description thereof will be restrained.

Figure 22:
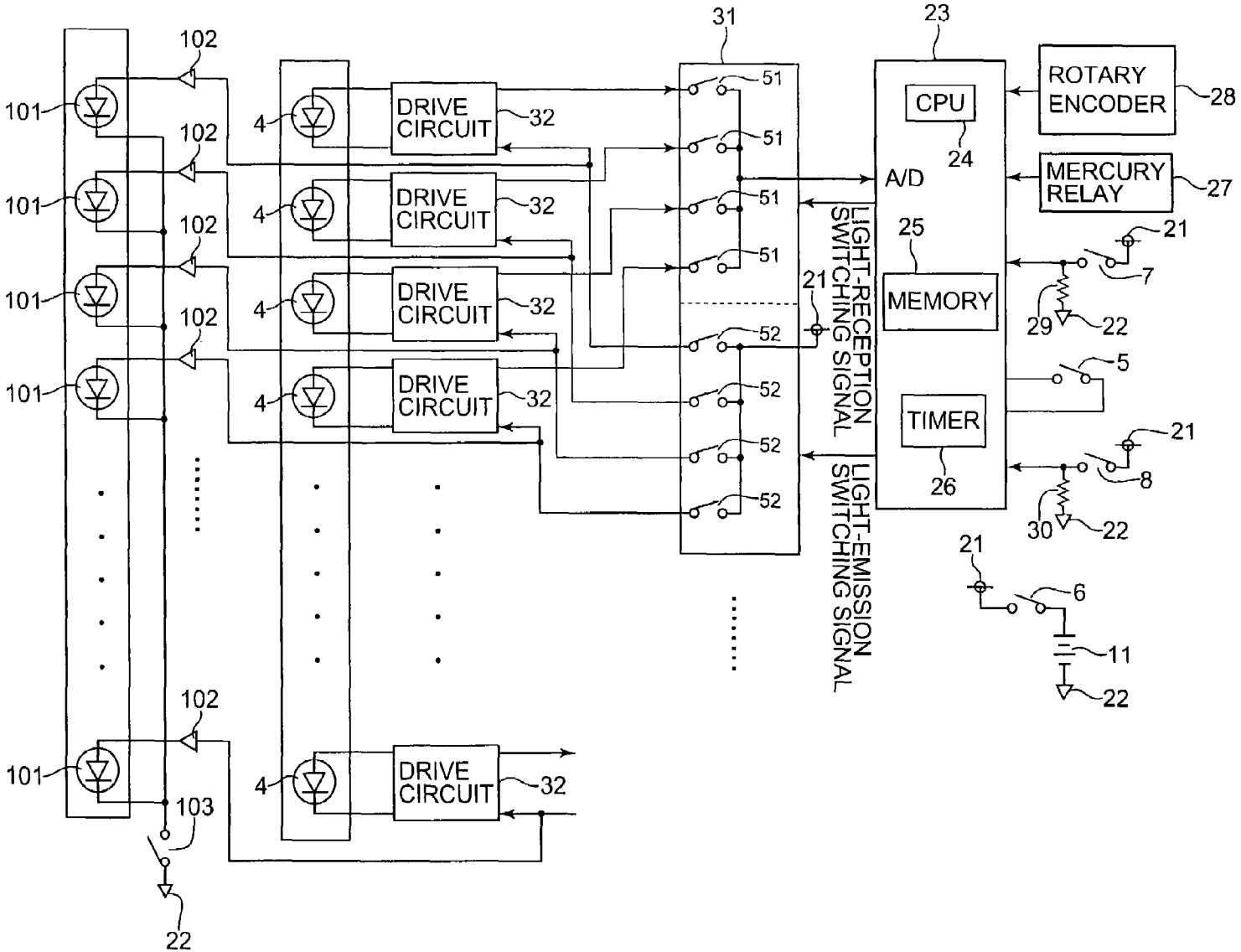
FIG. 22 is a circuit diagram showing an electric circuit controlling a plurality of light-emitting diodes and a plurality of different color light-emitting diodes, which is disposed inside the residual image display device of FIG. 21

FIG. 22 is a circuit diagram showing an electric circuit controlling the plural light-emitting diodes 4 and the plural different color light-emitting diodes 101, which is disposed inside the residual image display device of FIG. 21.

To a plurality of switches 52 of the other switch array, buffers 102 are connected respectively. The respective buffers 102 are connected to anodes of the respective different color light-emitting diodes 101. Cathodes of the plural different color light-emitting diodes 101 are connected commonly to a changeover switch 103. The changeover switch 103 is connected to a ground line 22. Since structures other than the above have the same functions as those in the residual image display device of the first embodiment, the same reference numerals and symbols as those in the first embodiment are used and detailed description thereof will be restrained.

Figure 23:
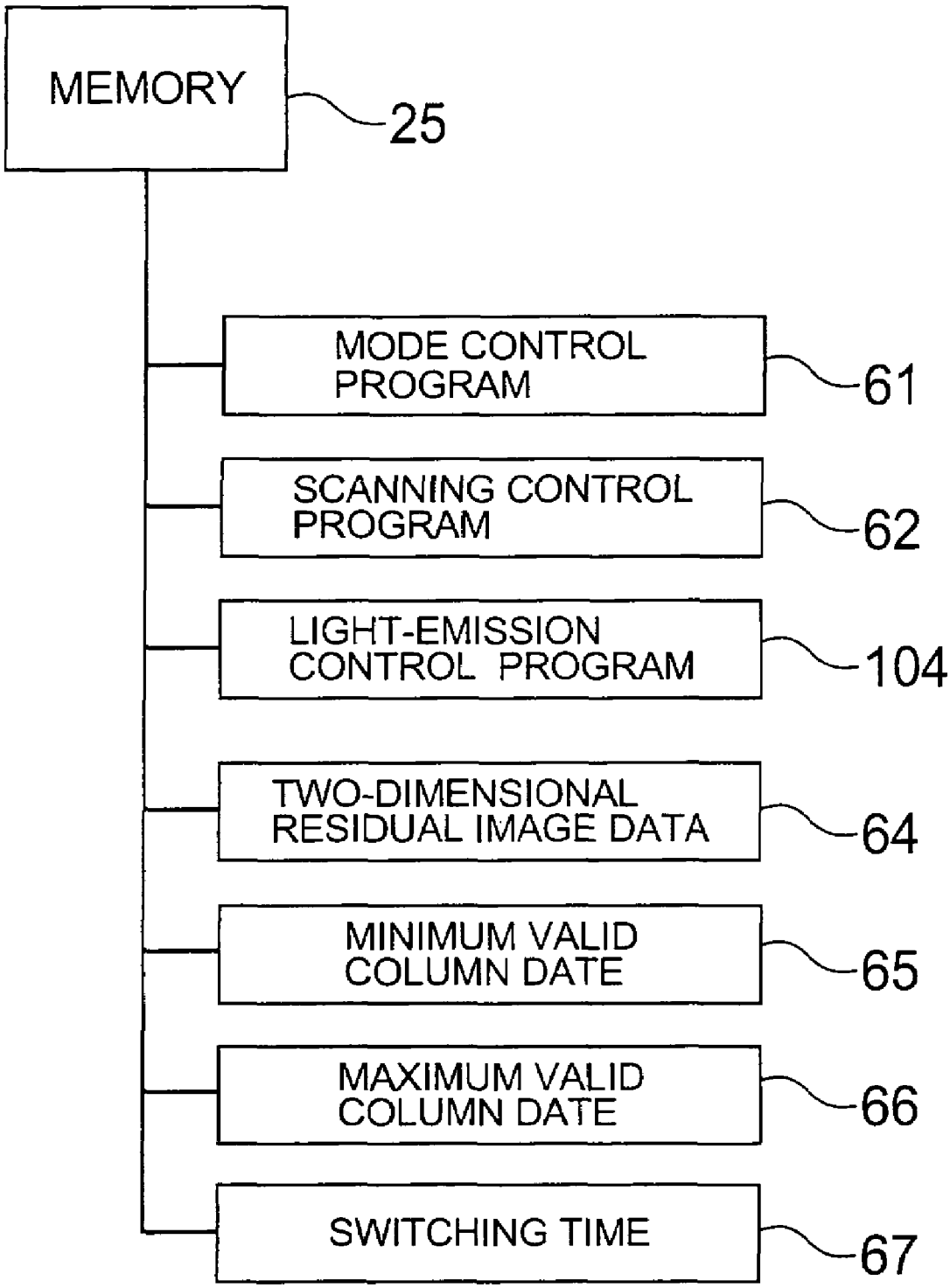
FIG. 23 is an explanatory diagram showing programs and data stored in a memory of a microcomputer in FIG. 22.

FIG. 23 is an explanatory diagram showing programs and data stored in a memory 25 of a microcomputer 23 in FIG. 22.

In the memory 25, a mode control program 61, a scanning control program 62, and a light-emission control program 104 are stored. In the memory 25, two-dimensional residual image data 64, minimum valid column data 65, maximum valid column data 66, and a switching time 67 are stored.

By a central processing unit 24 of the microcomputer 23 executing the mode control program 61, a mode control unit is realized. By the central processing unit 24 of the microcomputer 23 executing the scanning control program 62, a scanning control unit is realized. By the central processing unit 24 of the microcomputer 23 executing the light-emission control program 104, a light-emission control unit which functions as a light-emission control means is realized. The mode control unit, the scanning control unit, and the light-emission control unit according to the second embodiment execute the same control flows as those of the same names according to the first embodiment. In the programs and control flows according to the fourth embodiment, the same reference numerals and symbols are used to designate the programs and the steps of the same names as those in the first embodiment, and detailed descriptions thereof will be restrained.

The scanning control unit outputs a light-emission switching signal for making the plural light-emitting diodes 4 emit light, in accordance with a swing direction of the residual image display device, based on two-dimensional image data stored in the memory 25. At this time, the switch 52 of the other switch array, which is designated by the light-emission switching signal, is opened. The light-emitting diode 4 connected to the opened switch 52 via a drive circuit 32 emits light.

When the light-emitting diode 4 emits light as just described, a low level is inputted to the buffer 102 to which the opened switch 52 is connected. This buffer 102 outputs the low level. Therefore, even if the changeover switch 103 is closed, the different color light-emitting diode 101 does not light.

On the other hand, when the switch 52 of the other switch array is closed, the light-emitting diode 4 connected to the closed switch 52 via the drive circuit 32 does not light. When the light-emitting diode 4 does not light as just described, to the buffer 102 to which the closed switch 52 is connected, a high level is inputted. This buffer 102 outputs the high level. Therefore, if the changeover switch 103 is closed, the different color light-emitting diode 101 lights.

When the residual image display device is swung in a state that the changeover switch 103 is closed, the plural light-emitting diodes 4 are controlled their turning on and off states based on "1" of the two-dimensional image data, and the plural different color light-emitting diodes 101 are controlled their turning on and off states based on "0" of the two-dimensional image data. Therefore, there is a background image as a residual image is formed by the plural different color light-emitting diodes 101 on the periphery of the image formed as a residual image by the plural light-emitting diodes 4.

As stated above, in the residual image display device of the fourth embodiment, if the light-emitting diode 4 does not emit light, the different color light-emitting diode 101 corresponding thereto emits light. During a time that light emission of the light-emitting diode 4 is controlled, the background of the image is formed by the different color light-emitting diode 101. Therefore, even if in a state where a line drawing, a letter, or the like is displayed, an observer can easily view what kind of image is being displayed based on a contrast between a light color of the light-emitting diode 4 and a light color of the different color light-emitting diode 101. Even if a backside of a user swinging the residual image display device is slightly bright, the observer can view the image accurately based on a difference between the color of the background and the color of the image.

When the light-emitting diode 4 and the different color light-emitting diode 101 are widely apart each other, their light-emissions control are required to be based on their lightning timing/position differences, but when a distance between the light-emitting diode 4 and the different color light-emitting diode 101 is not so apart each other, their light-emissions are controlled as them existing in a same row.

Embodiment 5

A hardware structure of a residual image display device according to a fifth embodiment is the same as the structure of the residual image display device according to the fourth embodiment. To the hardware structure of the residual image display device, the same reference numerals and symbols as in the hardware structure in the residual image display device according to the fourth embodiment are used and detailed description thereof will be restrained.

Figure 24:
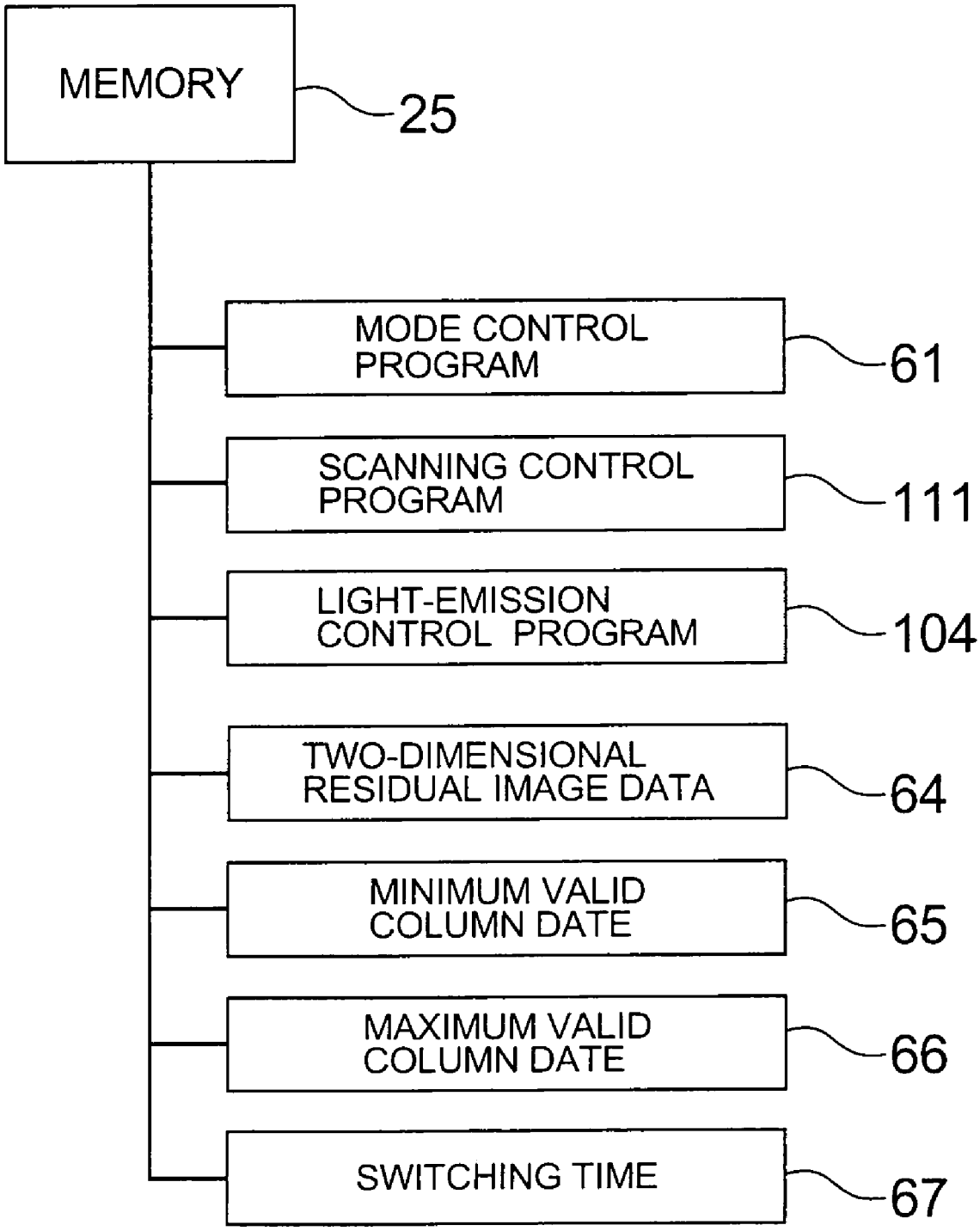
FIG. 24 is an explanatory diagram showing programs and data stored in a memory of a microcomputer of a fifth embodiment of the present invention.

FIG. 24 is an explanatory diagram showing programs and data stored in a memory 25 of a microcomputer 23 of the fifth embodiment of the present invention. In the memory 25, a mode control program 61, a scanning control program 111, and a light-emission control program 104 are stored. In the memory 25, two-dimensional residual image data 64, minimum valid column data 65, maximum valid column data 66, and a switching time 67 are stored.

By the a central processing unit 24 of the microcomputer 23 executing the mode control program 61, a mode control unit is realized. By the central processing unit 24 of the microcomputer 23 executing the scanning control program 111, a scanning control unit which functions as a scanning control means and a generating means is realized. By the central processing unit 24 of the microcomputer 23 executing the light-emission control program 104, a light-emission control unit is realized. The mode control unit and the light-emission control unit according to the fifth embodiment execute the same control flows as those having the same names according to the fourth embodiment. Therefore, in the programs and the control flows according to the fifth embodiment, the same reference numerals and symbols are used to designate the programs and the steps having the same names as those in the fourth embodiment, and detailed descriptions thereof will be restrained.

Figure 25:
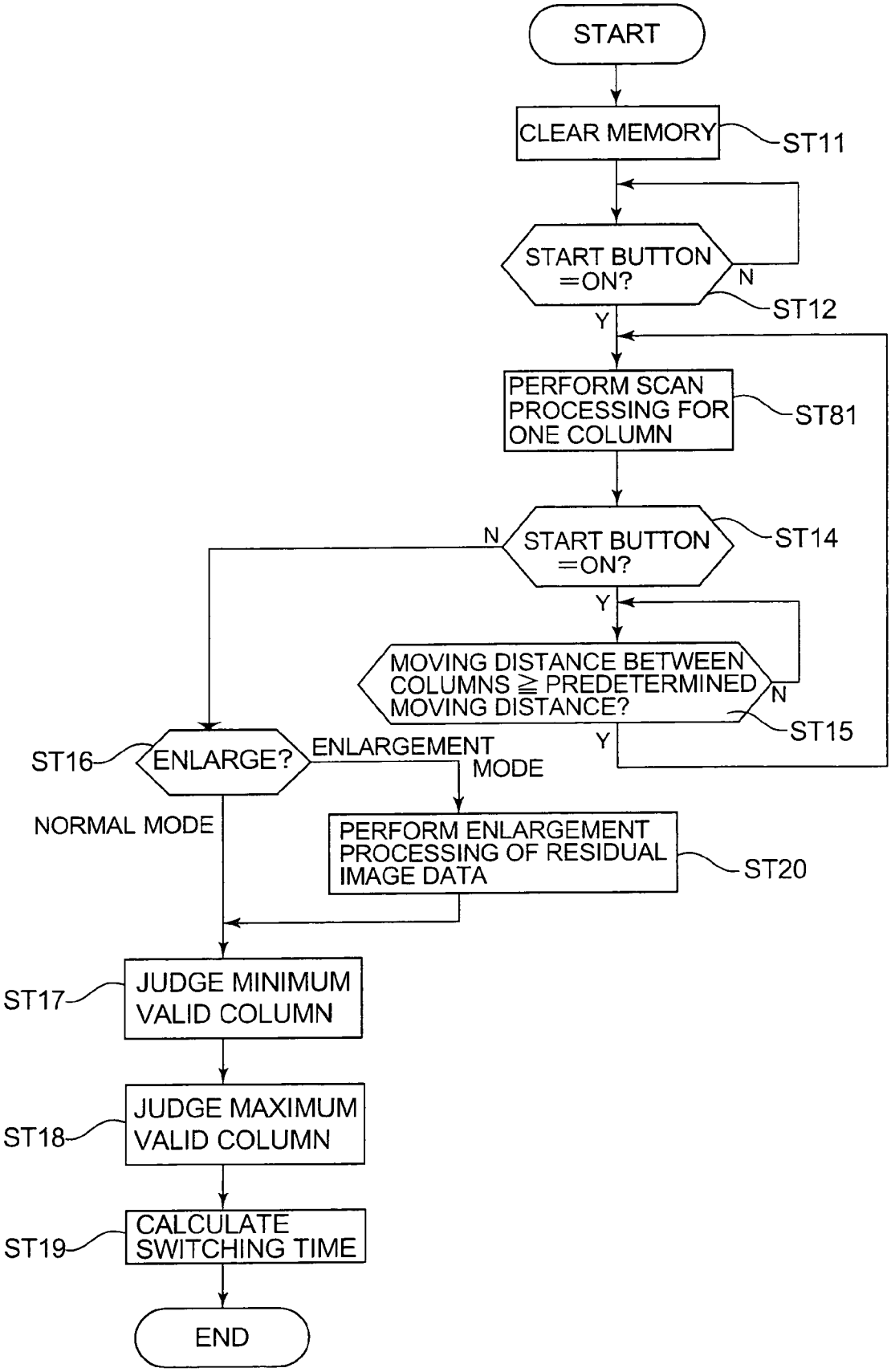
FIG. 25 is a flow chart showing control processing by a scanning control unit of the fifth embodiment of the present invention.

FIG. 25 is a flow chart showing control processing by the scanning control unit. Incidentally, when the scan processing is executed, a changeover switch 103 is closed. The scanning control unit erases respective data written in the two-dimensional residual image data 64, the minimum valid column data 65, the maximum valid column data 66, and the switching time 67, which are stored in the memory 25 (ST11). Thereafter, the scanning control unit becomes in a standby state waiting for a pressing operation of a start button 5 (ST 12).

By the start button 5 being pressed, the scanning control unit starts scan processing. The scanning control unit performs scan processing of the residual light image data on a column-by-column basis (ST81). More specifically, for example, the scanning control unit first outputs a light-reception switching signal for closing a switch 51 which is connected via a drive circuit 32 to a top light-emitting diode 4 in FIG. 22, as well as outputs a light-emission switching signal for closing a switch 52 which is connected via a drive circuit 32 to a first different color light-emitting diode 101 from a top in FIG. 22. Accordingly, the first different color light-emitting diode 101 from the top in FIG. 22 emits light. Then, the light is reflected on a sheet 71, and received by the top light-emitting diode 4 in FIG. 22. To the microcomputer 23, a voltage of a level corresponding to a received light intensity of the top light-emitting diode 4 in FIG. 22 is inputted.

The microcomputer 23, comparing the level of the voltage with a predetermined threshold level, judges a color of a image to be black when a voltage higher than the threshold level is inputted, and writes "1" into the memory 25 as the two-dimensional residual image data 64. The microcomputer 23 judges the color of the image to be white when a voltage lower than the threshold level is inputted, and writes "0" into the memory 25 as the two-dimensional residual image data 64. Incidentally, correspondence between the judged color and the value written in the memory 25 can be reversed. The predetermined threshold level can have been stored in the memory 25, for example.

When writing of the value based on the received light intensity of the top light-emitting diode 4 in FIG. 22 ends, the scanning control unit outputs the light-reception switching signal for closing the switch 51 which is connected via the drive circuit 32 to a second light-emitting diode 4 from the top in FIG. 22, as well as outputs the light-emission switching signal for closing the switch 52 which is connected via the drive circuit 32 to the second different color light-emitting diode 101 from the top in FIG. 22. The scanning control unit, comparing a level of a voltage corresponding to a received light intensity of the second light-emitting diode 4 from the top in FIG. 22 and the predetermined threshold level, writes a value corresponding to a judged color into the memory 25 as the two-dimensional residual image data 64.

The scanning control unit performs the light reception processing by the respective light-emitting diodes 4 as to all the light-emitting diodes 4. Accordingly, the same number of values as a number of the light-emitting diodes 4 is written into the memory 25 as the residual light image data for one column.

When scanning of the residual light image data for one column (ST81) as above is completed, the scanning control unit checks that the start button 5 is kept pressed (ST14). If the start button 5 is kept pressed, the scanning control unit judges a moving-distance-between-columns of the residual image display device, based on a number of pulses inputted from a rotary encoder 28 (ST15). When the moving-distance-between-columns of the residual image display device becomes equal to or more than a predetermined moving distance, the scanning control unit performs the above-described scan processing of the residual light image data for one column (ST81). Accordingly, residual light image data for two columns are written into the memory 25. The predetermined moving distance can have been stored in the memory 25 in advance, for example.

When the start button 5 become unpressed, based on a voltage level inputted from a scanning magnification setting switch 8, the scanning control unit executes an enlargement mode as necessary (ST16). Thereafter, based on the two-dimensional residual image data 64 stored in the memory 25, the scanning control unit generates minimum valid column data 65, maximum valid column data 66, and a switching time 67, and make the memory 25 store them (ST17, ST18, and ST19).

When writing and the like of the residual light image data for two columns into the memory 25 ends, the scanning control unit becomes a state where display of the image is possible.

The light-emission control unit controls light-emission of the plural light-emitting diodes 4 based on the two-dimensional residual image data 64 stored in the memory 25 and displays the residual image every time swung from side to side. If a changeover switch 103 is closed, the different color light-emitting diode 101 emits light at timing when the light-emitting diode 4 is turned off. There is a background image as a residual image is formed by the plural different color light-emitting diodes 101 on the periphery of the image formed as a residual image by the plural light-emitting diodes 4.

In the meantime, in the fifth embodiment, the different color light-emitting diode 101 that emits blue light and the light-emitting diode 4 that emits red light are combinedly used, and the light-emitting diode 4 that emits red light receives blue emitted light to scan the image.

The light-emitting diode 4 basically has a structure in which a P-type semiconductor and an N-type semiconductor are combined. The P-type semiconductor is connected to an anode, while the N-type semiconductor is connected to a cathode. When an energy gap between the P-type semiconductor and the N-type semiconductor is denoted by Eg, if a light having a wavelength shorter than a wavelength λ shown by a following equation 1 is made incident on a joint portion of the P-type semiconductor and the N-type semiconductor, photoelectromotive force occurs at the light-emitting diode.

$$\lambda=1240/Eg \text{ (nm)} \qquad \text{equation 1}$$

In the light-emitting diode 4 that emits red light, this wavelength λ is approximately 660 nm. In other words, the light-emitting diode 4 that emits red light generates the photoelectromotive force by the light having the wavelength shorter than approximately 660 nm incident thereon. The light-emitting diode that emits blue light emits light of a wavelength between 400 nm and 600 nm. Therefore, the light-emitting diode 4 that emits red light generates the photoelectromotive force by the light of the different color light-emitting diode 101 that emits blue light. On the other hand, the light-emitting diode that emits blue light does not generate the photoelecromotive force by the light of the light-emitting diode 4 that emits red light.

By using, as the different color light-emitting diode 101, the light-emitting diode which emits light of the wavelength shorter than that of an emitted light color of the light-emitting diode 4 used as a light-receiving element, it is possible to make the light-emitting diode 4 generate an electromotive force by the light of the different color light-emitting diode 101 so as to scan the image. Among the emitted light colors (in a range of visible light) of the light-emitting diodes are, for example, one which emits red light of approximately 660 nm, one which emits orange light of approximately 620 nm, one which emits yellow light of approximately 570 nm, one which emits yellow green light of approximately 565 nm, one which emits blue light of approximately 490 nm, one which emits white light, and so on. The one that emits white light can be one that purely emits white light or one combined of ones that emit three colors of red, green, and blue light.

Therefore, if the light emitting diode which emits red light is used as the light-emitting diode 4, for example, scanning of the image is possible with either one which emits any other color being used as the different color light-emitting diode 101. On the other hand, if the light-emitting diode that emits blue light is used as the light-emitting diode 4, scanning of the image is possible only in a combination with the one that emits white light by combination of three colors of red, green, and blue, as the different color light-emitting diode 101.

As stated above, the residual image display device of the fifth embodiment makes the different color light-emitting diode 101 emit light and makes the light-emitting diode 4 receive reflected light of that light, to scan the image. Therefore, at a time of scanning the image, the light-emitting diode 4 needs to perform only scanning.

The respective embodiments described above are preferable embodiments of the present invention, and various kinds of changes and modification are possible without departing from the gist of the present invention.

In the respective embodiments described above, there are described examples in which plural light-emitting diodes 4 are arranged in a row from the end of the tip section 3 toward the grip section 2, but it is possible that the light-emitting diodes are circularly arranged in a circumferential direction to be a plane vertical to an axis direction of the residual image display device and the residual image display device is operated in a way to be swung from side to side in the axis direction. In addition to this, it is also possible that the residual image display device is formed into a balloon shape with the light-emitting diodes being arranged along a ruling direction thereof or with the light-emitting diodes being arranged along a direction of an auxiliary line.

In the respective embodiments described above, the residual image display device has a bar-shaped housing. In addition to this, the structure of the present invention can also be used, for example, for a flicker which is used by a police officer or a traffic control person for road repair by holding it in hand, for a mars light which is installed on a police car, a fire engine, or the like, or which is provided for security, for a revolving light, or for a signal light or so forth. By making these light emitting devices scan and display arbitrary images or letters as image data, as compared with a case of simply blinking or lighting on, it is possible to display a message and the like for respective purposes so that more correct and easy-to-understand instruction or display can be readily performed, and at the same time a modification thereof can be easily made.

INDUSTRIAL AVAILABILITY

A residual image display device of the present invention can be applied to a residual image display device having a plurality of light-emitting diodes.

The invention claimed is:

1. A residual image display device, comprising:

a substantially bar-shaped housing;

a plurality of light-emitting diodes arranged along a longitudinal direction of said housing;

a light-emitting means for making each of said light-emitting diodes emit light individually, a light-receiving means for outputting a signal based on photoelectromotive force generated in individual light-emitting diodes among said plurality of light-emitting diodes;

a scanning control means for controlling said light-emitting means to make each of said light-emitting diodes emit light which is positioned neighboring said each of part of light-emitting diodes that said light-receiving means outputs said signal based on the photoelectromotive force of, and for controlling said light-receiving means to output said signal in the light-emitting state;

a generating means for generating two-dimensional residual image data of said plurality of light-emitting diodes, based on the signals which are outputted from said light-receiving means and which are based on the photoelectromotive force of said part of light-emitting diodes;

a storing means for storing said two-dimensional residual image data; and a light-emission control means for controlling said light-emitting means to make said plurality of light-emitting diodes emit light based on said two-dimensional residual image data stored in said storing means, in accordance with swinging of said housing.

2. The residual image display device according to claim 1, further comprising a detecting means for detecting a change of a swing direction of said housing, wherein, with using a timing when said detecting means detects the change of the swing direction as a standard timing, after only a period from a finishing timing of last light emission of said light-emitting diodes by said two-dimensional residual image data to said timing when said detecting means detects the change of the swing direction is passed, said light emission control means starts light-emission of said light-emitting diodes by said two-dimensional residual image data.

3. A residual image display device, comprising:

a substantially bar-shaped housing;

a plurality of light-emitting diodes arranged along a longitudinal direction of said housing;

a light-emitting means for making each of said plurality of light-emitting diodes emit light individually;

a light-receiving means for outputting a signal based on photoelectromotive force generated in individual light-emitting diodes;

a scanning control means for cotrolling said light-emitting means to make each of said light-emitting diodes emit light which is positioned neighboring said each of light-emitting diodes that said light-receiving means outputs said signal based on the photoelectromotive force of, and for controlling said light-receiving means to output said signal in the light-emitting state;

a generating means for generating two-dimensional residual image data of part of light-emitting diodes among said plurality of light-emitting diodes, based on the signals which are outputted from said light-receiving means and which are based on the photoelectromotive force of said plurality of light-emitting diodes;

a storing means for storing said two-dimensional residual image data; and a light-emission control means for controlling said light-emitting means to make said part of light-emitting diodes among said plurality of light-emitting diodes emit light based on said two-dimensional residual image data stored in said storing means, in accordance with swinging of said housing.

4. The residual image display device according to claim 3, further comprising a detecting means for detecting a change of a swing direction of said housing, wherein, with using a timing when said detecting means detects the change of the swing direction as a standard timing, after only a period from a finishing timing of last light emission of said light-emitting diodes by said two-dimensional residual image data to said timing when said detecting means detects the change of the swing direction is passed, said light emission control means starts light-emission of said light emitting diodes by said two-dimensional residual image data.

5. A residual image display device, comprising a substantially bar-shaped housing;

a plurality of light-emitting diodes arranged along a longitudinal direction of said housing;

a light-emitting means for making said light-emitting diodes emit light individually;

a light-receiving means for outputting a signal based on photoelectromotive force generated in individual light-emitting diodes;

a scanning control means for controlling said light-emitting means to make each of said light-emitting diodes emit light which is positioned neighboring said each of said light-emitting diodes that said light-receiving means outputs said signal based on the photoelectromotive force of, and for controlling said light-receiving means to output said signal in the light-emitting state;

a generating means for generating two-dimensional residual image data used for light emission control of said light-emitting diodes, based on the signals which are outputted from said light-receiving means and which are based on the photoelectromotive force of said light-emitting diodes;

a storing means for storing said two-dimensional residual image data; and a light-emission control means for controlling said light-emitting means to make said plurality of light-emitting diodes emit light based on said two-dimensional residual image data stored in said storing means, in accordance with swinging of said housing, wherein said light-emission control means controls light emission so that a light emission period of said light-emitting diodes based on said two-dimensional residual image data is equal to or less than 1/30 second.

6. The residual image display device according to claim 5, further comprising a detecting means for detecting a change of a swing direction of said housing, wherein, with using a timing when said detecting means detects the change of the swing direction as a standard timing, after only a period from a finishing timing of last light emission of said light-emitting diodes by said two-dimensional residual image data to said timing when said detecting means detects the change of the swing direction is passed, said light emission control means starts light emission of said light-emitting diodes by said two-dimensional residual image data.

7. A residual image display device, comprising:

a substantially bar shaped housing;

a plurality of light-emitting diodes arranged along a longitudinal direction of said housing;

a plurality of back face light-emitting diodes arranged along said longitudinal direction of said housing, in a back face of said housing that is a reverse-side of said plurality of light-emitting diodes;

a light-emitting means for making said light-emitting diodes and said back face light-emitting diodes emit light individually;

a light-receiving means for outputting a signal based on photoelectromotive force generated in individual light-emitting diodes;

a scanning control means for controlling said light-emitting means to make each of said light-emitting diodes emit light which is positioned neighboring said each of said light-emitting diodes that said light-receiving means outputs said signal based on the photoelectromotive force of, and for controlling said light receiving means to output said signal in the light-emitting state;

a generating means for generating two-dimensional residual image data used for light emission control of said light-emitting diodes, based on the signals which are outputted from said light-receiving means and which are based on the photoelectromotive force of said light-emitting diodes;

a storing means for storing said two-dimensional residual image data; and a light emission control means for controlling said light-emitting means to make said plurality of light-emitting diodes and said back face light-emitting diodes emit light based on said two-dimensional residual image data stored in said storing means, in accordance with swinging of said housing.

8. A residual image display device, comprising:

a substantially bar shaped housing;

a plurality of light-emitting diodes arranged along a longitudinal direction of said housing;

a plurality of different color light-emitting diodes emitting light of a color different from that of said plurality of light-emitting diodes, being arranged correspondingly to each of said plurality of light-emitting diodes;

a light-emitting means for making said light-emitting diodes and said different color light-emitting diodes emit light individually;

a light-receiving means for outputting a signal based on photoelectromotive force generated in individual light-emitting diodes;

a scanning control means for controlling said light-emitting means to make each of said light-emitting diodes emit light which is positioned neighboring said each of said light-emitting diodes that said light-receiving means outputs said signal based on the photoelectromotive force of, and for controlling said light-receiving means to output said signal in the light a emitting state;

a generating means for generating two-dimensional residual image data used for light emission control of said light-emitting diodes, based on the signals which are outputted from said light receiving means and which are based on the photoelectromotive force of said light-emitting diodes;

a storing means for storing said two-dimensional residual image data; and a light emission control means for controlling said light-emitting means to make said plurality of light-emitting diodes emit light based on said two-dimensional residual image data stored in said storing means, and controlling said light-emitting means to make said plurality of different color light-emitting diodes corresponding to each of said light-emitting means which does not emit light, in accordance with swinging of said housing.

9. The residual image display device according to claim 8, wherein said scanning control means controlling, instead of to make each of said light-emitting diodes emit light which is positioned neighboring said each of said light-emitting diodes to perform scanning, to make each of said different color light-emitting diodes emit light which is positioned neighboring said each of said light-emitting diodes to perform scanning, and for controlling to make said each of light-emitting diodes receive reflected light of said light.

* * * * *